United States Patent [19]

Scherübl

[11] Patent Number: 5,046,751

[45] Date of Patent: Sep. 10, 1991

[54] CONNECTING ARRANGEMENT

[75] Inventor: Franz Scherübl, Radstadt, Austria

[73] Assignee: Varpat Patentverwertungs AG, Littau, Switzerland

[21] Appl. No.: 415,130

[22] Filed: Sep. 28, 1989

[30] Foreign Application Priority Data

Sep. 30, 1988 [AT] Austria ..... 2429/88

[51] Int. Cl.[5] ..... A63C 9/00

[52] U.S. Cl. ..... 280/607; 280/617

[58] Field of Search ..... 280/617, 618, 633, 634, 280/636, 629, 607, 602

[56] References Cited

U.S. PATENT DOCUMENTS

| | | | |
|---|---|---|---|
| 3,797,844 | 3/1974 | Smolka et al. | 280/617 |
| 3,917,298 | 11/1975 | Haff | 280/417 |
| 4,230,338 | 10/1980 | Weigg et al. | 280/618 |
| 4,896,895 | 1/1990 | Bettosini | 280/618 |

FOREIGN PATENT DOCUMENTS 0104185 5/1987 European Pat. Off. .

*Primary Examiner*—David M. Mitchell
*Attorney, Agent, or Firm*—Collard, Roe & Galgano

[57] ABSTRACT

A connecting arrangement for fixing a ski boot to a ski comprises a supporting element having thereon coupling devices in the form of joins, for gripping the ski boot. The supporting element is coupled to the ski by means of a mounting device. The mounting device may comprise two mounting parts which are mutually adjustable in a longitudinal plane extending perpendicularly to the upper part of the ski and substantially parallel to the longitudinal direction of the ski, or the mounting device may be deformable in the longitudinal plane mentioned above. Deformations of the ski, when in use, relative to the boot are thereby taken up.

2 Claims, 14 Drawing Sheets

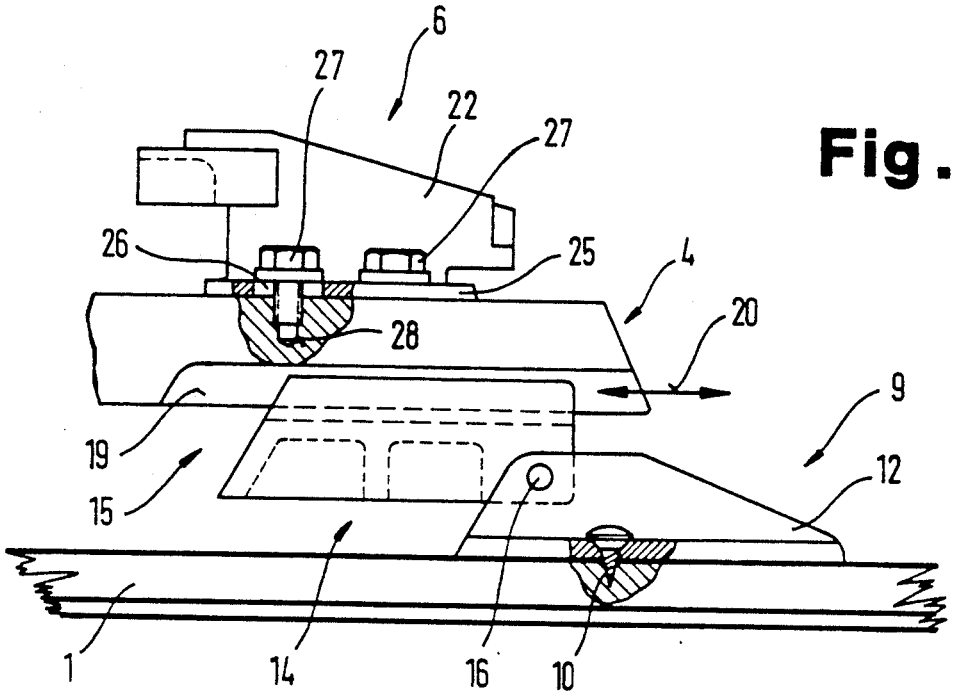
Fig.3
Fig.4
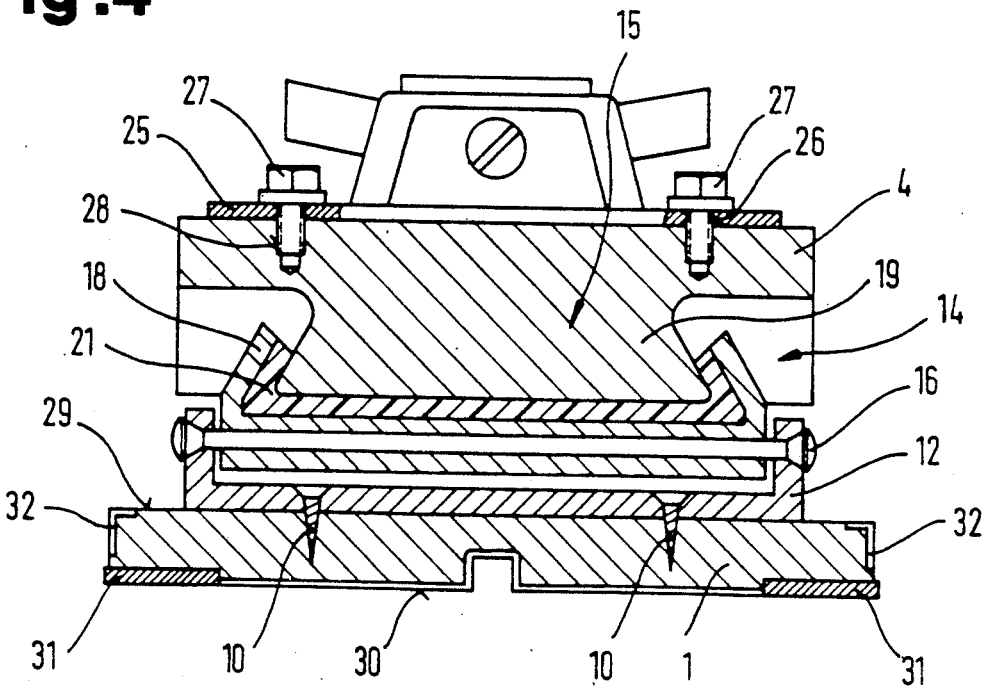

50
22
9
12
16
41
40
6
15
42
49
53
52
7
2
4
48
3
51
52
53
50
43
23
17
8
29
1

Fig. 15
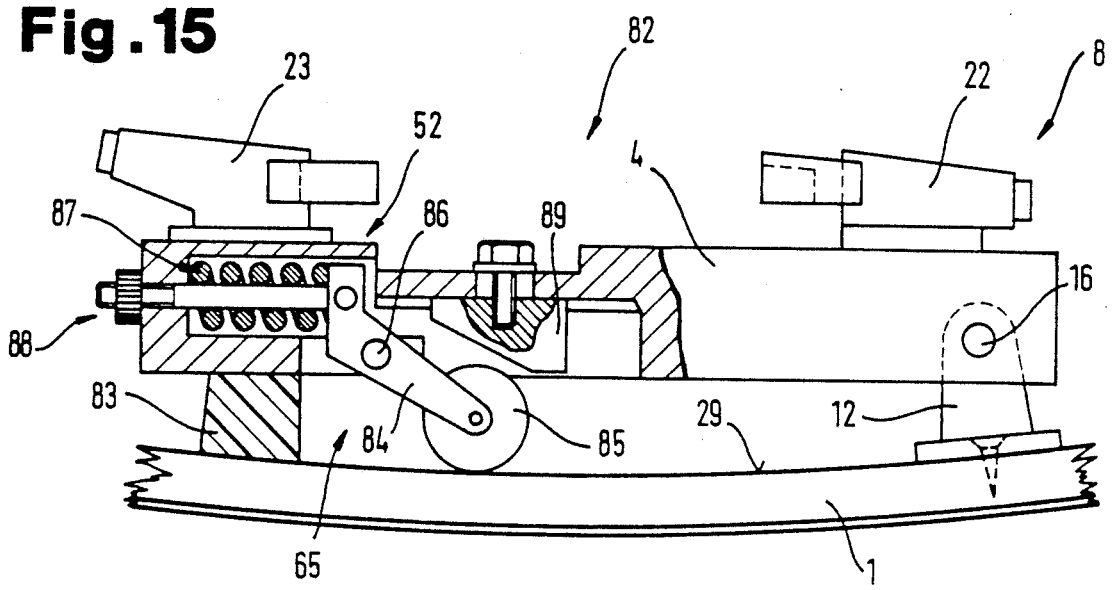
Fig. 16
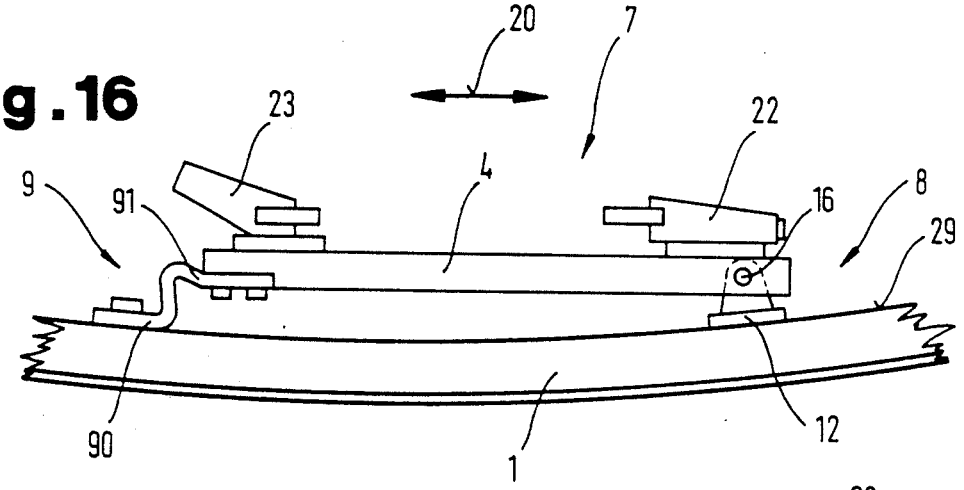
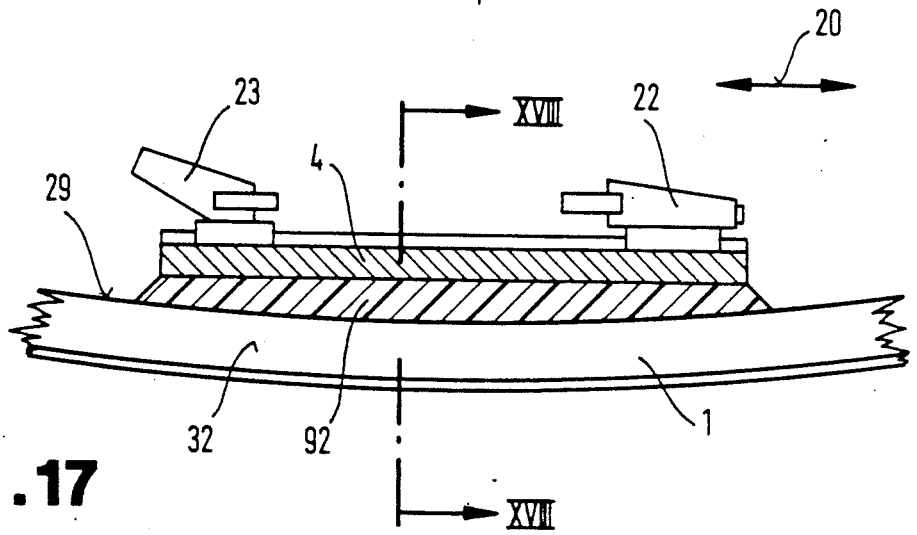
Fig. 17

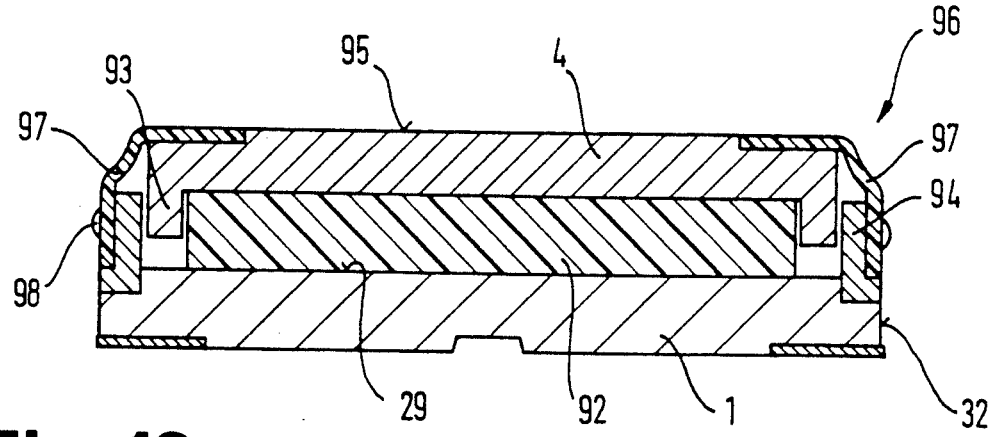
Fig.18
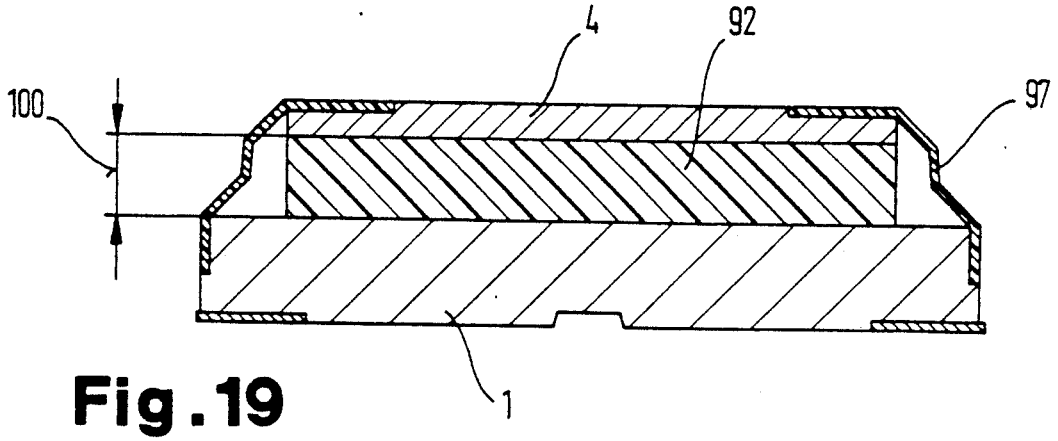
Fig.19
Fig.20
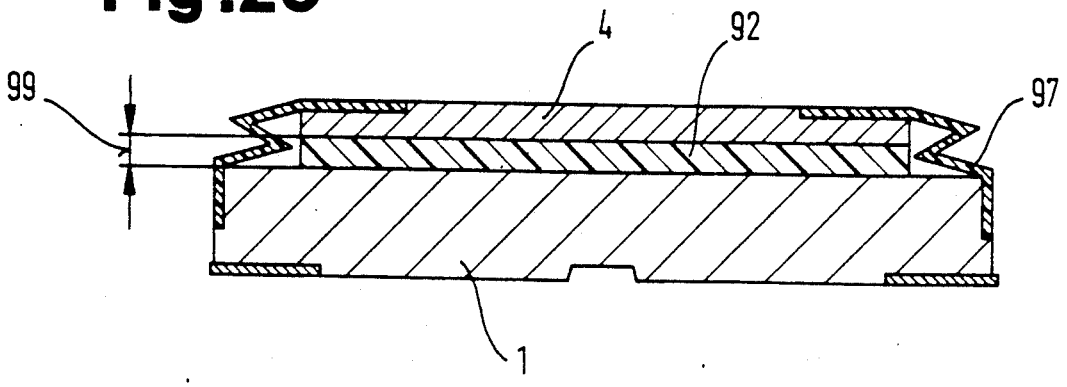

CONNECTING ARRANGEMENT

BACKGROUND OF THE INVENTION

This invention relates to a connecting arrangement, in particular for fixing a ski boot to a ski, in which a supporting element on which coupling parts of a coupling device are arranged is fixed, in particular adjustably, by means of a mounting device substantially in a transverse plane oriented obliquely or perpendicularly with respect to the longitudinal axis of the ski at a predeterminable distance from the ends of the ski.

One such connecting arrangement, according to EP-B-104 185, is constructed as a ski binding and comprises a front jaw and a rear jaw or heel supporting hold-down device, as the coupling device. In order to improve the damping of impacts and vibrations acting on the ski, the front jaw and the heel supporting device are arranged on a supporting element which is resistant to bending. The supporting element is rigidly screwed to the ski at one end, whilst in the region of the opposite end of the supporting element, in the longitudinal direction of the ski, the screws are guided in elongate slots extending parallel to the longitudinal direction of the ski. Longitudinal movement of the front part of the ski in relation to the supporting element is thereby achieved. A respective resilient damping element is arranged between the fixing means and the end regions of said elongate slots which lie on either side thereof, to dampen said impacts and vibrations. The longitudinal movement between the ski and the supporting element, triggered by bending of the ski vertically with respect to its running face are thus dampened. Because the supporting element is resistant to bending, the distance between front jaw and rear jaw or the angular position between the contact face of the ski boot and the contact face of the front jaw and rear jaw on the upper face of the ski invariably extend in parallel independently of elastic deformation of the ski. This arrangement has the disadvantage, however, that the elasticity of the ski is thus undesirably reduced In a connecting arrangement of a ski binding of the company ESS with them v.a.r. System, the differences between the arc length of the deformed ski and the distance, determined by the toe length, between front jaw and rear jaw resulting from the elastic deformation of the ski under stresses perpendicular to the running face are compensated for in that the rear jaw is mounted adjustably in the longitudinal direction of the ski in a longitudinal device fixed to the ski and is connected movably in the longitudinal direction of the ski to the front jaw by means of a tensile band. Because of the longitudinal adjusting device, length compensation between the ski which deforms in an arcuate shape and the sole of the ski boot forming the toe can be achieved when the front jaw and rear jaw are fixed with longitudinal spacing by the boot. The necessary clamping forces between the front jaw and the rear jaw are applied by way of the tensile band. With the tensile band, the distance between the front jaw and the rear jaw is fixed during and after coupling of the ski boot to the ski and, at the same time, the distance between the rear jaw and the fixing point of the front jaw is fixed. The front jaw and the rear jaw are fixed to the ski in this case and their contact faces facing the upper face of the ski adopt different angular positions relative to the contact face of the ski boot as the ski is deformed perpendicularly with respect to its upper face. This causing undesirable stresses between front jaw, rear jaw and ski boot.

SUMMARY OF THE INVENTION

The object of the present invention is to allow free deformability of the ski in the region of the coupling device and a predetermined relative position between the ski boot and the coupling parts of the coupling device, even with differing deformation of the ski.

This object is achieved in that at least one mounting device comprising two mounting parts which are mutually adjustable in a longitudinal plane extending substantially perpendicularly to the upper face of the ski and substantially parallel to the longitudinal direction thereof and/or a mounting member or deformation region which is elastically deformable in this longitudinal plane, is provided. The advantage of this resides mainly in the fact that relative tilting of the coupling device, for example a front jaw and a rear jaw, and the ski boot, is avoided and the releasing forces of the coupling device, for example of an automatic ski binding, are not altered during differing deformation of the ski. At the same time, however, improved contact area of the running face of the ski with differing bending thereof, in particular vibratory stresses in the front or rear region of the ski, is ensured in the region of the coupling device. Such large area contact of the running face of the ski means that only slight ground pressure is sufficient under the most varied stress and travel conditions, preventing sinking of the ski and associated braking and deceleration forces. This allows of higher speed round bends and more sensitive control of changes of direction, in particular during ski racing. Non-racers have the advantage that the effort required for changes of direction is reduced because of the reduced ground pressure, and the ski therefore turns more easily. Said effort can therefore be reduced in an unforeseeable, and surprisingly simple manner for entry into bends, both for ski facing and for skiing as a hobby. At the same time, the track behaviour and therefore the ease of running of the ski is improved as differences in the ground pressure and the associated sudden decelerations and accelerations are reduced. In particular, harmonious diffusion of stress and uniform distribution of rigidity are achieved over the length of the ski in that the deformation movement of the ski is no longer blocked by the coupling device holding the ski boot, edge gripping being improved over the entire length of the ski edge. A further advantage is that the harmonious stress diffusion and therefore the properties of the ski desired by the ski producer are maintained under the most varied travel and loading conditions as they can no longer be adversely affected by the coupling device, that is the binding and the ski boots held by the binding.

One mounting device may comprise two mounting parts which are adjustable about a pivot pin orientated perpendicularly to the longitudinal plane and a further mounting device in a further transverse plane spaced in the longitudinal direction of the ski, comprising two mounting parts which are adjustable about a pivot pin orientated perpendicularly to the longitudinal plane, and a longitudinal guide arrangement. By virtue of the arrangement of two joints, of which one also allows longitudinal adjustment in the longitudinal direction of the ski, the ski can adjust itself vertically with respect to the upper face as well as in its longitudinal direction relative to the coupling device without such adjusting movement obstructing this movement of deformation because the spacing and angular position of the coupling parts are fixed via the ski boot.

Said deformation region may be provided by a lyre-shaped construction of, or an attenuation in the material of, the mounting device or of a mounting part, so that longitudinal movement of the ski relative to the supporting element is allowable if suitable spring arrangements are provided.

An elastically deformable mounting member or a deformation region, in particular of a mounting part, may be arranged in each case in two transverse planes spaced from one another in the longitudinal direction of the ski, so that the deformation path of the mounting member or the stress in the deformation region can be reduced owing to the arrangement which is spaced in the longitudinal direction of the ski.

The mounting device may be arranged between the end of the supporting element and the ski, and if one of two guide elements of said longitudinal guide arrangement which are adjustable relative to one another is movably connected to the ski or to a part, for example a mounting part, movably connected thereto and the other is movably connected to the supporting element or to a part, for example a mounting part, fixed thereon or is formed by it, as the mounting device and the longitudinal adjusting device can therefore easily be integrated in one component.

According to an embodiment, the mounting parts are fixed to the ski and to the supporting element and are articulated via the pivot pin. The advantage being that no additional components are required for connecting the individual mounting parts of the mounting device.

According to a further embodiment, the mounting device has two lever-type mounting parts which are pivotally mounted on the ski and on the supporting element by a respective pivot pin and are arranged as a parallel linkage. As a result, the supporting element is invariably adjusted substantially perpendicularly to the upper face of the ski and the ski user's sense of balance is not, therefore, impaired with a mounting device of this construction.

A mounting device may be connected to the ski substantially in the central region thereof, in particular in the central third, of a length of the supporting element, a resilient element being arranged between the supporting element and the ski, to exert a pressing or tensile force in the direction of the upper face of the ski, onto the supporting element, it being sufficient to provide a single mounting device consisting of several mechanical components.

A further mounting device formed by a resilient mounting member, in particular a damping element, may be arranged at least in one end region of the supporting element between the supporting element and the upper face of the ski, as, in addition to the damping of impacts affecting the ski, deformation of the ski resulting only from the externally imposed stresses can occur in the front and rear end region thereof.

One mounting part may be formed by a bearing part which is supported in an opening in the supporting element via a damping member, a guide length parallel to the longitudinal direction of the ski being greater between end walls of the opening than a thickness of the bearing part in the same direction, and a pressure plate fixed to the bearing part via a fixing element being supported on the side of the damping member remote from the upper face of the ski. In this embodiment, the relative adjustment required in the longitudinal direction of the ski and perpendicularly to the upper face, between the supporting element and the ski, for free deformation of the ski can be achieved with few individual parts and without complex mechanisms, by using a bolt-type bearing part.

The damping member may extend over the supporting element or the opening in the direction of the upper face and in the direction of the pressure plate, as the relative movements between supporting element and ski can thus be damped by the floating mounting of the supporting element.

A guide width between lateral faces of the bearing part may, however, substantially correspond to a width of the opening in the same direction, so that exact lateral guidance between the supporting element and the ski is obtained with a resilient connection between the ski and the supporting element.

According to a further embodiment, the mounting part between the ski and the supporting element is formed by a leaf spring having a deformation region constructed, for example, in a lyre-shape and/or as an attenuation of material and arranged in a vertical plane extending in the longitudinal direction of the ski. Sufficiently accurate lateral guidance between supporting element and ski can be achieved by using a leaf spring which is sufficiently wide transversely of the longitudinal direction of the ski, and suitably arranged deformation regions allow adjusting movements not only perpendicularly to the upper face of the ski but also in the longitudinal direction of the ski.

According to a further embodiment the mounting part is formed by a torsion spring which preferably has an end, for example a cross head, engaging in the supporting element, spring arms and bearing arms, wherein the mounting device simultaneously acting as damping member is guided substantially without clearance perpendicularly to the upper face and perpendicularly to lateral edges via a cover plate on the ski in the region of the spring arms. The torsion springs have the advantage that the change in the spring characteristic at markedly varying temperatures has only a slight effect on the spring characteristic and accurate lateral guidance between supporting element and ski can be achieved by an appropriate arrangement.

The torsion spring, may, however, in particular in the region of its spring arms, be movably mounted in the longitudinal direction of the ski as the torsion spring need only absorb those movements which extend in reach to the upper face of the ski, while the relative adjustments in the longitudinal direction of the ski between the ski and the supporting element are achieved due to the movable mounting of the torsion spring.

A covering element consisting of an elastically deformable material, for example plastics material or rubber, may be arranged between the upper face of the ski and an underside of the supporting element facing it. The advantage of this is that snow and ice cannot penetrate during the relative movement between supporting element and ski, and the supporting element is prevented from freezing onto the upper face of the ski, even if the ski is not used for short periods.

The covering element between the supporting element and lateral edges of the ski may be provided by an elastically deformable edge strip, for example with concertina walls extending in longitudinal direction or from an elastically deformable film of rubber or plastics material, so that the penetration of snow and ice between the supporting element and the ski is prevented independently of the construction of the mounting device and, at the same time, desirable solutions can be achieved owing to the design, since a continuous covering element of the lateral edge type can be used.

The covering element may be a telescopic strip comprising two strip parts which are adjustable substantially perpendicularly or obliquely with respect to the upper face of the ski and one of which is connected to the ski or its lateral edge and the other to the supporting element, so that suitably rigid strips such as aluminium strips which can optionally even contribute to clearance-free transmission of the lateral guiding faces can be used.

The covering element extends only over a length extending parallel to the longitudinal direction of the ski, such complex constructions for covering the intermediate space between supporting element and ski only being used in the region where they are absolutely essential.

The covering element may be constructed as a mounting member and/or a vibration damping device, such as a dual function is thus fulfilled using a single component and the advantages of the covering element can be combined with the advantages of damping of impacts acting on the ski.

According to a further embodiment, the supporting element may be constructed so as to be resistant to bending at least parallel to said longitudinal direction so that, despite the free deformation of the ski relative to the coupling device, higher loading of the ski boot due to its support on the supporting element can be avoided.

The supporting element on either side of the mounting device may be at a greater distance from the upper face of the ski facing the mounting device as the distance from the mounting device increases when the supporting element and ski extend in parallel, because a greater deformation path of the ski relative to the supporting element can be achieved with minimum height between the supporting element and the ski.

The supporting element may comprise two supporting element parts or coupling parts connected to the ski via mounting devices in mutually spaced transverse planes and a tensile band extending parallel to the longitudinal direction of the ski, and being connected at a fixed, predeterminable distance to the supporting element parts or the coupling parts, so that the height of the connecting arrangement can be kept small by using the tensile bands.

According to a further embodiment the supporting element is provided by a supporting layer part of the ski, which is arranged at a distance from further supporting layer parts in the longitudinal direction of the supporting element and/or perpendicularly to the ski upper face, an elastically deformable transition part being preferably arranged in an intermediate space between the individual supporting layer parts, so that the arrangement of its own supporting element and the associated raising of the center of gravity can be avoided. The costs of a connecting arrangement can therefore be kept low, the weight of the ski not being significantly increased overall.

The transition part between the supporting layer parts of the ski arranged in succession in the longitudinal direction of the supporting element may provide a vibration damping device, as the path of movement between the individual parts of the supporting layer of the ski can, therefore, also be influenced in an advantageous manner.

A vibration damping device may be arranged between the superimposed supporting layer parts of the ski, so that, in particular, impacts which occur substantially perpendicularly to the running face or upper face of the ski and which are harmful to the user's spine can be damped.

According to a further embodiment, the vibration damping device is formed from two mounting blocks each connected to one of the two supporting layer parts of the ski, and a resilient element, for example a helical spring or a pneumatic spring, arranged between these mounting blocks is articulated to a respective mounting block. Sensitive regulation of the vibration damping device is possible owing to the deflection of the damping movement from the plane of the ski via the leverage thus achieved.

A vibration damping device may be arranged between the supporting element and an upper face of the ski associated therewith, as the advantages described above can also be achieved with a ski produced in conventional form.

The vibration damping device may be constructed for the damping of vibrations directed substantially perpendicularly to the upper face of the ski, as the damping resulting from differing deformation of the ski can be damped independently of the impacts acting perpendicularly on the running face.

An adjusting device for the damping path, for example a screw gear, may be allocated to the vibration damping device, as the damping effect of the vibration damping device can thus simply be adapted to the respective conditions of use and to differing types of snow and slope conditions.

According to a further embodiment, the mounting part connected to the ski forms a longitudinal guide track of the longitudinal guide arrangement in which the pivot pin arranged on the other mounting part connected to the supporting element is guided as guide element, so that length compensation and the adjustment of inclination between the ski and the coupling or connecting arrangement is simplified.

The mounting member may, however, be elastically deformable predominantly in the longitudinal direction and in the direction perpendicular to the running face of the ski and formed, in particular, from rubber or plastics material, for example a plastics foam, for example PU-foam or the like, as sufficient lateral stability of the mounting member can thus be ensured for transmitting lateral shearing forces from the supporting element onto the ski without complex additional measures.

A damping device may be arranged between the mounting parts of the mounting device and/or the supporting element or the ski, so that it need not be provided with its own damping device.

A damping device may be arranged between the ski elements of the longitudinal guide device and/or the ski or the supporting element, so that the longitudinal guide device can be used for damping or avoiding vibrations directed perpendicularly to the ski upper face.

The damping device may comprise a damping member formed by a helical spring or a torsion bar, as such damping members can easily be exchanged and the damping characteristic of the damping device can quickly be adapted to differing conditions for use, for example soft or hard slopes or different types of ski.

An adjusting device for the damping path of the damping member may be allocated to the damping device, so that the damping characteristic thereof can be altered during use of the ski without exchanging individual parts.

According to a further embodiment, the longitudinal adjusting device comprises stops which are adjustable relative to the guide elements so that the deformation movement of the ski can be limited in an adjustable range.

The stops may be formed by damping members, for example plastics blocks of elastically deformable polyurethane foams or the like, so that the damping device can advantageously be integrated into the longitudinal adjusting device.

A lateral guide device may be allocated to the supporting element or to the coupling device and/or the mounting member, so that clearance free transmission of the lateral forces from the supporting element onto the ski and vice versa can take place in each case despite the relative adjustability of the supporting element relative to the ski.

The lateral guide device may, however, be integrated into the longitudinal guide arrangement and the guide elements of the longitudinal guide arrangement guided without clearance in the lateral direction, as a compact construction of the connecting arrangement can thus be achieved while still achieving additional advantages.

According to a further embodiment, the guide elements have two guide regions which are spaced from one another in the adjusting direction and preferably one guide length which is greater than a guide width and, for example, is 1.5 times the guide width, so that relative tilting of the supporting element and the ski and therefore undesirable obstruction of the deformation thereof are avoided during relative adjustment in the longitudinal direction of the ski.

The guide elements may be coated with a low friction slide covering, for example Teflon, or be formed from it, in order to avoid jamming of the guide track with snow or ice at the most extreme temperatures and in the most varied snow conditions also almost friction-free adjustment between the guide elements of the longitudinal guide arrangement is achieved.

BRIEF DESCRIPTION OF THE DRAWINGS

FIG. 3 is a simplified, enlarged, diagrammatic side view showing part of the connecting arrangement of FIG. 1 between the ski and the ski boot, partly in section;

FIG. 4 is a view taken on the lines IV—IV in FIG. 3;

FIG. 15 is a greatly simplified diagrammatic side view partly in section showing another embodiment of the connecting arrangement;

FIG. 16 is a greatly simplified diagrammatic side view showing a further embodiment of the connecting arrangement;

FIG. 17 is a greatly simplified diagrammatic side view partly in section showing yet a further embodiment of the mounting device;

FIG. 18 is a view taken on the lines XVIII-XVIII in FIG. 17;

FIG. 19 is a cross-sectional view of an embodiment of a covering element of the connecting arrangement when the ski is loaded and deformed;

FIG. 20 is a similar view to that of FIG. 19 but showing the covering element of the connecting arrangement when the ski is in a rest position;

DETAILED DESCRIPTION OF THE INVENTION

Figure 1:
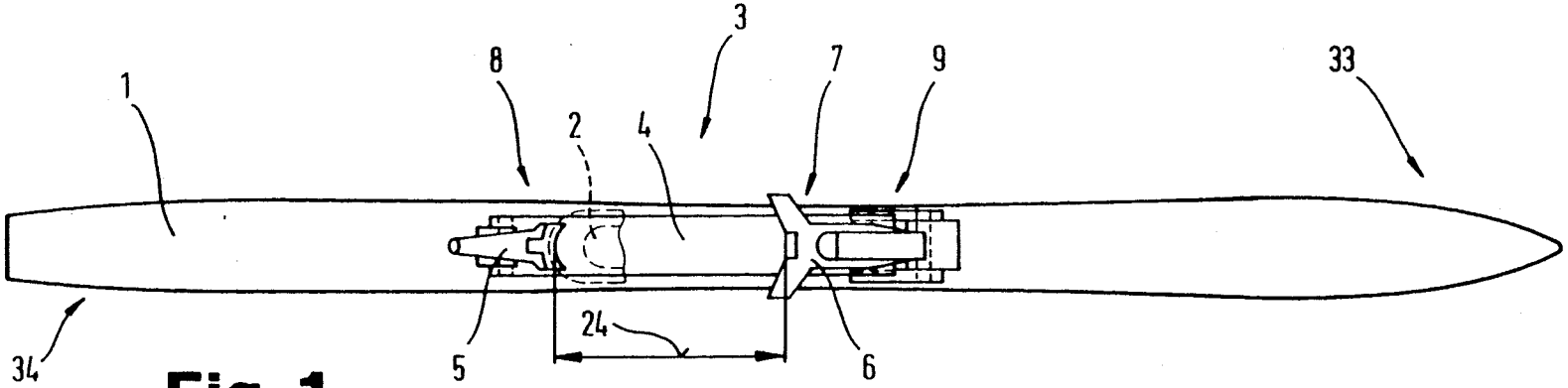
FIG. 1 is a top plan view of a ski showing a connecting arrangement according to a first embodiment of the invention, between the ski and a coupling device for a ski boot.

As shown in FIGS. 1 to 7, a ski boot 2 is movably connected to a ski 1 by way of a connecting arrangement 3. The connecting arrangement 3 comprises a supporting element 4 to which are fixed coupling parts 5 and 6 of a coupling device 7 forming a safety ski binding, for example a rear jaw or a heel supporting down device and a front jaw. The heel supporting device and the front jaw may be of conventional construction. In the embodiment shown, the supporting element 4 is fixed to the ski 1 by way of mounting devices 8 and 9 in the region of the coupling parts 5 and 6.

Figure 2:
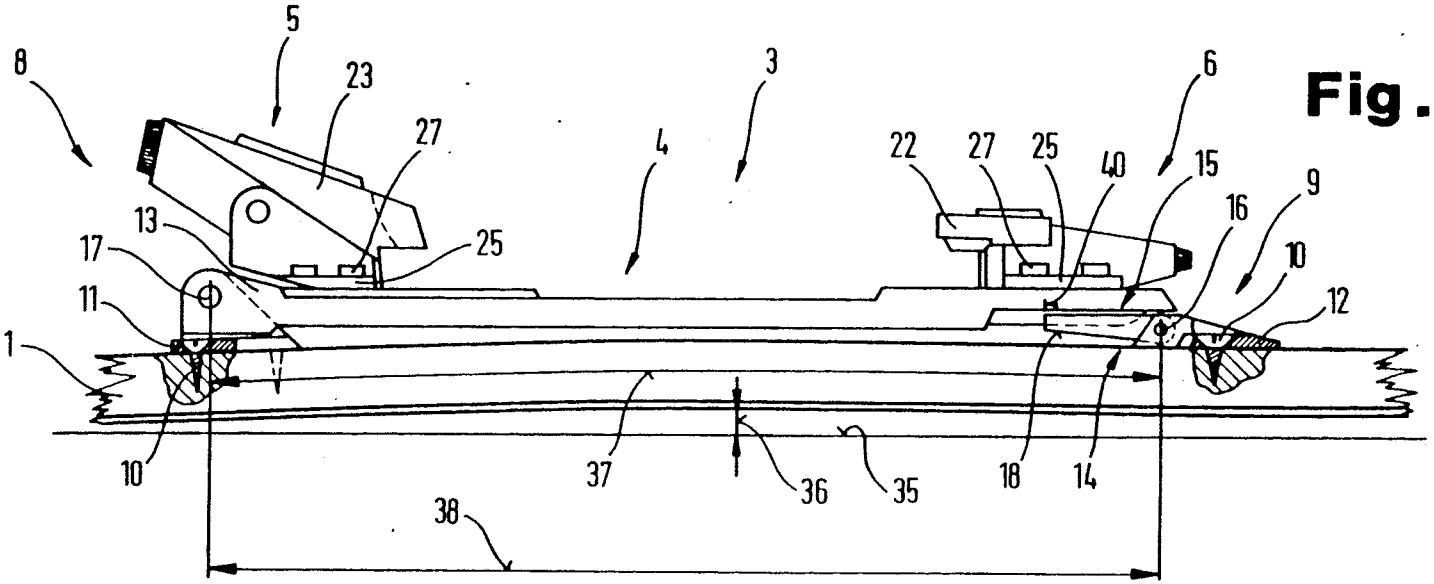
FIG. 2 is a side view, partly in section showing a part of the ski in the region of the connecting device of FIG. 1 when the ski is unloaded.

As best seen in FIG. 2, each of the mounting devices 8 and 9 consists of a mounting part 11 or 12 fixed to the ski 1 by means of fixing means 10, for example screws or anchor pins. Further mounting parts 13 and 14 connected to the supporting element 4 are associated with the mounting parts 11 and 12, the mounting part 13 being fixed, for example, on the supporting element 4, and in particular being formed integrally therewith, while the mounting part 14 is movably connected to the element 4 with interposition of a longitudinal guide arrangement 15 to allow pivotal movement of the part 14 about a pivot pin 16 connecting the mounting parts 12 and 14.

The mounting parts 11 and 13 of the mounting device 8 are also connected by means of a pivot pin 17 and are rotatable relative to one another thereabout.

As best seen in FIGS. 3 and 4, a guide element 18 defining a dovetail guide duct is arranged in the mounting part 14 which is articulated to the mounting part 12 by means of the pivot pin 16. A guide element 19 connected to the supporting element 4 or formed integrally therewith is mounted for movement relative to the mounting device 9 in the longitudinal direction of the ski 1, as indicated by the double arrow 20 (FIG. 3), in said duct defined by the guide element 18. In order to allow displacement of the supporting element 4 relative to the guide element 18 with a minimum of friction, the surface of the guide element 18 facing the guide element 19 or the surface of the guide element 19 facing the guide element 18 may be provided with low friction slide covering 21. The covering 21 may be provided for example, by a Teflon coating or guide strips of Teflon. Such coating or strip may either be screwed onto a metal part of the guide element 18 or 19 or may be adhered thereto. The guide elements in question may, however, be made of low friction material for example Teflon. The adherence of snow and ice to such elements during use of the ski is inhibited or is prevented by the use of such low friction materials.

Figure 5:
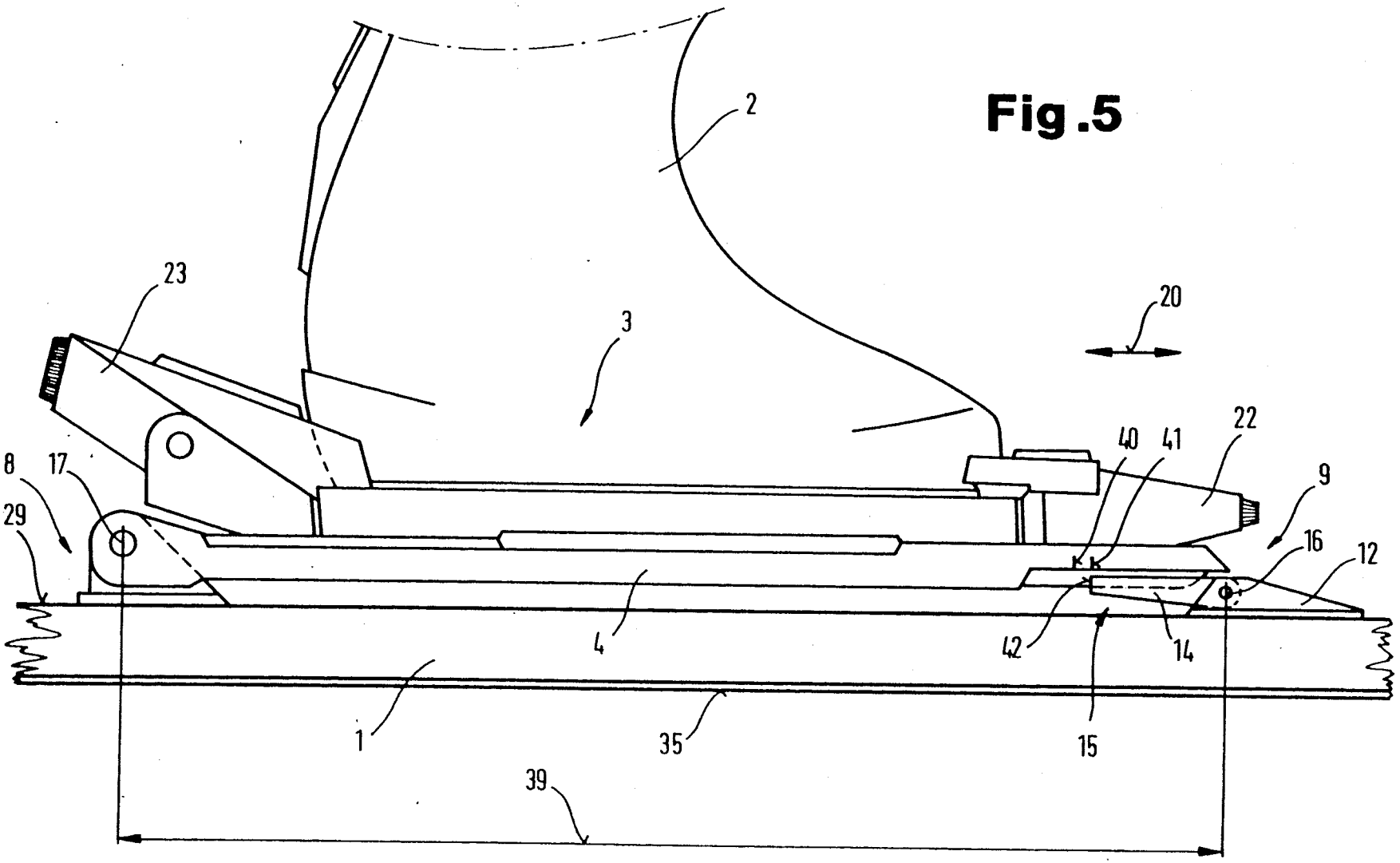
FIG. 5 is a diagrammatic side view showing the ski in the region of the connecting arrangement of FIGS. 1 to 4, during deformation of the ski by the inherent weight of a user.

As best seen in FIG. 5, the coupling part 6 according to the present embodiment is provided by a front jaw 22 of a ski binding, the coupling part 5 being provided by a rear jaw 23 which may be described as a heel supporting down device or heel automaton in order to allow a distance 24 (FIG. 1) to be predetermined between the front and rear coupling parts 6 and 5 and the front jaw 22 and the rear jaw 23, at least one of the two coupling parts 5 or 6, but preferably both of them, may be adjustable relative to the supporting element 4. FIGS. 3 and 4 show schematically adjusting means to this end for the front jaw 22. Elongate slots 26 extending in the longitudinal direction of the ski (double arrow 20) are formed in lateral flanges 25 of the part 6. There extend through the slots 26, fixing means 27 in the form of screws meshing with internal threads 28 in the supporting element 4. After release of said screws, therefore, the front jaw 22 can be adjusted in one of the directions of the double arrow 20 to alter the distance 24 which can thus easily be adapted to differing boot sizes. A similarly, the rear jaw 23 may be provided with corresponding flanges 25 and fixing means 27 so that its position relative to the supporting element 4 can be adjusted.

Instead of such means for adjusting the position of the front jaw 22 and the rear jaw 23 relative to the supporting element 4, which means are shown in greatly simplified and schematic form in order to assist an understanding thereof, conventional means employing toothed plates, screws gears of the like may alternatively be used.

In the drawings, in particular in FIGS. 1 to 4, the proportions of the individual parts are shown as being greatly distorted relative to one another, and the sizes of some of the parts have been exaggerated in order to allow the function and mode of operation of the connecting arrangement 3 to be explained more clearly. It has been attempted to keep the overall height of the individual parts, particularly in a direction perpendicularly to the upper face 29 or the running face 30 of the ski, as small as possible so that the center of gravity does not shift excessively through a distance between the upper face 29 and the supporting element 4.

A steel edge 31 of the ski 1 and a lateral edge 32 thereof, which may be of metal, a plastics material or a compound material, are shown schematically in FIGS. 3 and 4.

Figure 6:
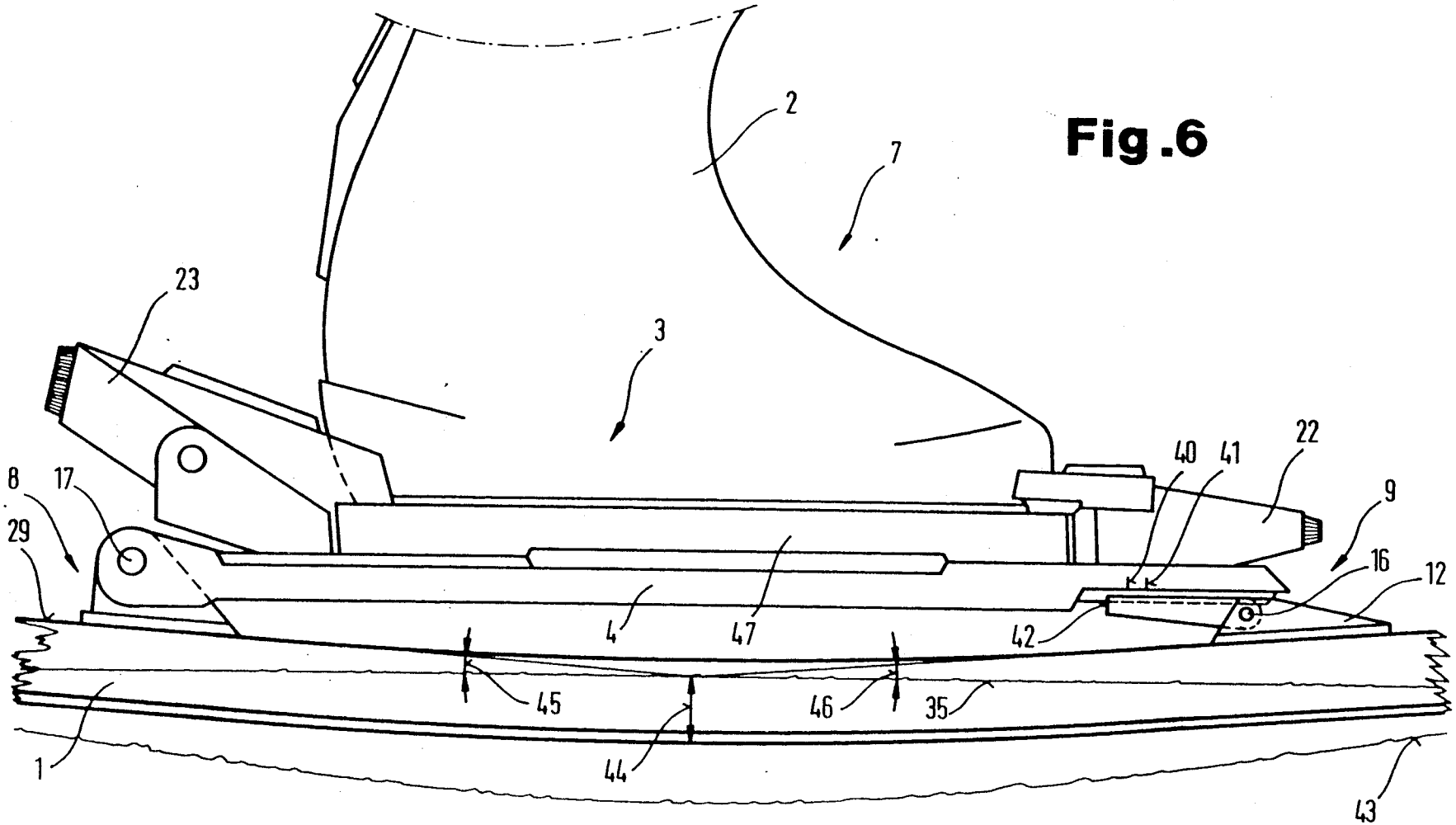
FIG. 6 is a similar view to that of FIG. 5, but showing the connecting arrangement during average loading of the ski.

The mode of operation of the connecting arrangement 3 between the ski 1 and the ski boot 2 under differing loads will now be described with reference to FIGS. 5 to 7.

The ski 1 with the connecting arrangement 3 is shown in FIG. 2 with the ski unloaded. FIG. 5 shows the position of the connecting arrangement 3 when the ski is loaded by the weight of a user during travel on a smooth slope, while FIGS. 6 and 7 show the position of the connecting arrangement 3 and the effect thereof when average or high stresses act on the ski as a result of the nature of the slope, for example in the case of reproduced terrain or a bumpy slope.

Because of the elasticity inherent in the ski 1 and the corresponding shaping thereof, the ski 1 in the unloaded state rests in the region of its blade 33 and its end 34 which are shown in FIG. 1. The regions of the ski 1 located between the blade 33 and the end 34 are spaced at differing distances 36 (FIG. 2) from a contact face 35, which distances 36 depend on the construction and the application of the ski. As demonstrated by a comparison of FIGS. 2 and 5, an arc length 37 between the pivot pins 16 and 17 of the mounting devices 8 and 9 is greater than a toe length 38 between the two pivot pins 16 and 17. If the ski 1 is now loaded by weight of a user, as shown in FIG. 5, when the ski 1 rests flat on the contact face 35, causing a distance 39 between the two pivot pins 16 and 17 to be greater than the toe length 38 in FIG. 2 as the distance 39 now corresponds to the arc length 37 according to FIG. 2. This difference in the arc length 37 projected onto the contact face 35 (FIG. 2) and the distance 39 is compensated for by the connecting arrangement 3 by virtue of the movement of the mounting device 9 relative to the supporting element 4 in the longitudinal guide arrangement 15. This relative movement is illustrated schematically in FIGS. 2 and 5 by marks 40 and 41 each of which shows the position of a front edge 42 of the mounting part 14 receiving the guide element 18, with reference to the supporting element 4.

If the longitudinal guide arrangement 15 were not provided, this difference in length between the front jaw 22 and the rear jaw 23 would need to be compensated for by appropriate compensating mechanisms or springs in the coupling device 7. In addition, the mounting device 9 with the pivot pin 16 is arranged between the longitudinal guide arrangement 15 and the ski 1. By virtue of the mounting device 9, the ski 1 can not only be moved in the longitudinal direction, according to the double arrow 20, relative to the supporting element 4, but it can also adjust itself in any desired angular position relative to the supporting element 4 according to the respective course of the curve This can best be seen by further observation of the deformation of the ski 1 during the load variations shown in FIGS. 6 and 7. Even during moderate bending of the ski 1, for example, when travelling over slightly uneven terrain with moderate humps well spaced from one another in the direction of travel, the ski 1 is bent as the blade 33 runs, for example, onto a hump 43 shown schematically in FIG. 6. This bending has, for example, an arc height 44 relative to a flat contact face 35, as shown in FIG. 6. Such deformation of the ski, however, also causes the ski to pivot in the region of the mounting devices 8 and 9 about schematically illustrated angles 45 and 46. Since the mounting devices 8 and 9 are provided with respective pivot pins 16 and 17. The ski can adopt any desired angle 45 or 46, with respect to a flat contact face 35 or to the flat supporting element 4 which is designed to be resistant to bending. The deformation of the ski 1 is only opposed by slight resistance so that harmonious diffusion of stress and therefore continuous edge gripping over the entire edge length can be achieved. This also means, however, that the properties of the ski 1 desired by the ski producers are not adversely affected by the binding. In fact, if the guide element 18 of the longitudinal guide arrangement 15 were stationary instead of the mounting part 12, or was rigidly arranged on the upper face 29 of the ski, then the ski would be forced into a position parallel to the supporting element 4 in the region of the guide element 18, or the front jaw 22 would be angled with respect to the ski boot 2 if the front jaw 22 was fixed without the provision of a supporting element which is resistant to bending, for example, a strip-form supporting element deformable perpendicularly to the upper face 29 of the ski 1. This would result in jamming which would again need to be compensated for by corresponding compensating levers or additional spring elements in the bindings to ensure an equally high releasing force, even during differing bending of the ski 1.

If the sole 47 of the ski boot 2 is suitably rigid, as mentioned above, the supporting element 4 may be constructed as a tensile band deformable perpendicularly to the upper face 29 of the ski 1 instead of being resistant to bending perpendicularly to the upper face 29 and preferably also in the direction of the lateral edges 32. As the supporting element 4, in the embodiment shown, for example, in FIGS. 1 to 6, then has merely the function of maintaining the clamping of the ski boot 2 between the front jaw 22 and the rear jaw 23, a reduced distance between the sole 47 and the upper face 29 of the ski can be achieved. The mounting devices 8 and 9 as well as the longitudinal guide arrangement 15 can also be integrated into the front jaws 22 and the rear jaws 23.

Figure 7:
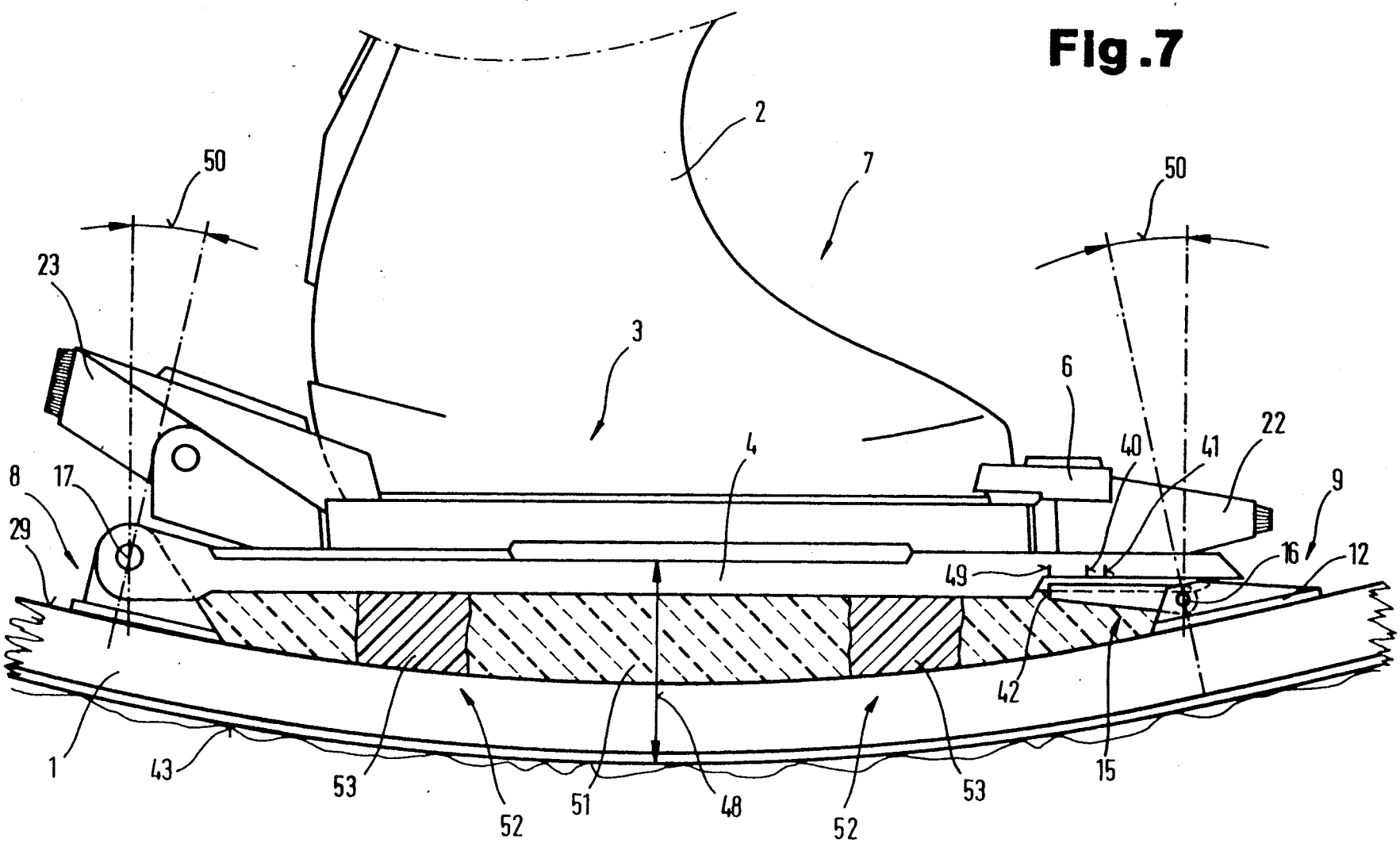
FIG. 7 is a similar view to that of FIG. 6 but showing the connecting arrangement during extreme loading of the ski and further illustrating a damping device.

The deformation and the relative adjustment of the ski 1 are more clearly demonstrated by the bending of the ski 1 as shown schematically and to an exaggerated extent in FIG. 7 in order to assist an understanding of the effect of the connecting arrangement 3. Such extreme deformation of the ski 1 can, however, occur briefly during rapid travel on a lumpy slope and, in particular, during slalom and giant slalom racing. It is important to maintain edge gripping in this phase of deformation to prevent the racer from being carried off between the individual gates owing to the reduced edge grip and losing time owing to the transverse position of the ski.

The connecting arrangement 3 allows even such extreme deformation of the ski to occur unobstructed by the coupling device 7 which is fixed to the ski. The change in length resulting from the large arc height 48 during such deformation of the ski, is most clearly indicated by the distances between the marks 40, 41 and 49 in FIG. 7. Such a deformation path can be achieved without obstructing the deformation of the ski only by virtue of this path of movement in the longitudinal guide arrangement 15 in connection with the articulated adjustability of the ski 1 relative to the supporting element 4 by virtue of the arrangement of the pivot pins 16 and 17 in the region of the mounting device 8 and 9. A perfect edge grip along the hump 43 is nevertheless achieved. Without the provision of free pivotability of the ski 1 relative to the ski boot 2 or the supporting element 4, such deformation of the ski 1 could not be achieved. Pivoting of the coupling part 6 or of the front jaw 22 and, to the same or a similar extent, also of the rear jaw 23, about an angle 50, relative to a ski boot 2 clamped to the ski can also be compensated for by mechanical adjustment but only with the aid of extremely complex mechanisms.

As shown, in particular in FIG. 7, an intermediate space 51 formed during differing deformations between the ski 1 and the supporting element 4 can be used to accommodate a vibration damping device 52 formed, for example, by two elastically deformable resilient blocks 53 of rubber or of a resilient plastics material or a suitable combination thereof. If only one resilient block is provided, to extend from the mounting device 8 into the region of the mounting device 9, between the supporting element 4 and the ski 1, the stresses in the resilient block arising from the differing deformations and the subsequent damping movements can advantageously be reduced. Moreover, by virtue of the vibration damping device or the resilient block 53, the intermediate space 51 is enclosed between the ski 1 and the supporting element 4 in each phase of movement as indicated by the broken line hatching, and the penetration of snow, ice or moisture between these two elements is therefore prevented. Uninterrupted operation of the connecting arrangement 3 can, therefore, be guaranteed even in new snow conditions or on slopes which have not yet been rolled.

As will be appreciated from the foregoing the advantages described above can be achieved independently of the construction of the front and rear jaw of the coupling device 7 so that conventional coupling devices can be used in connection with a supporting element 4 which is resistant to bending or a supporting element which is deformable at least perpendicularly to the upper face 29 of the ski.

Further embodiments of the invention will now be described with reference to FIGS. 8 to 26.

Figure 8:
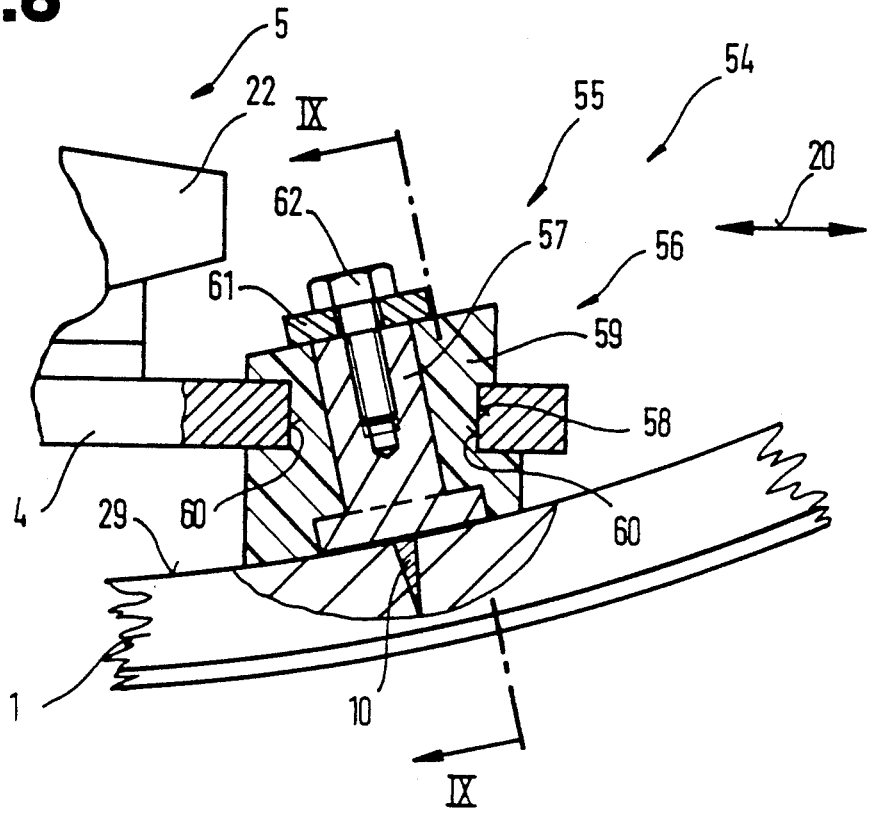
FIG. 8 shows another embodiment of a mounting device for the connecting arrangement in section taken on the lines VIII—VIII in FIG. 9.

FIG. 8 shows a mounting device 54 in which a coupling part 5, for example a front jaw 22 of the coupling device 7 or also where a supporting element 4 is provided, the supporting element 4 is connected to the ski 1 via mounting parts 55, 56. The mounting part 55 is constituted by a bearing part 57 which extends transversely of the ski 1 and is rigidly fixed to the upper face 29 of the ski 1 by means of fixing means 10, for example screws. The mounting part 56 consists, for example, of an elastically deformable material, for example a resilient rubber element or a corresponding elastically deformable plastics material or a spring arrangement. The mounting part 56 is fixed non-positively and/or positively in an opening 58 in the coupling part 5 or in the supporting element 4 and, in the present case, simultaneously acts as a damping member 59. It extends, in each case, between the bearing part 57 and at least the end walls 60 of the opening 58 which face th bearing part 57 and are opposed in the longitudinal direction (double arrow 20) of the ski 1. The mounting part 56 is fixed with respect to the bearing part 57 by a pressure plate 61 which is fixed thereto by a fixing element 62, for example a screw.

Figure 9:
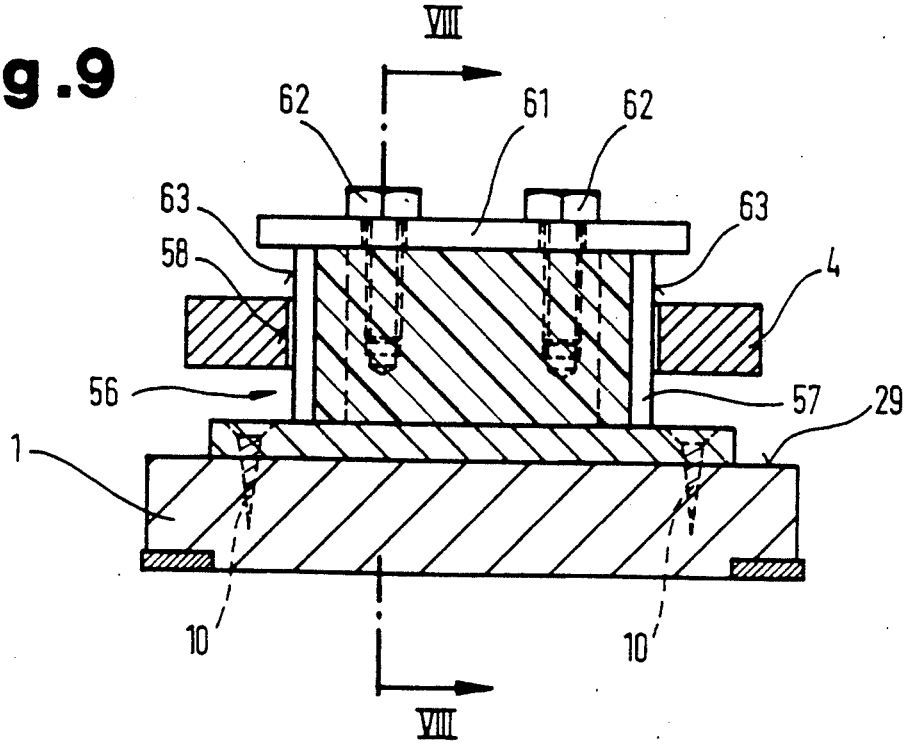
FIG. 9 is a view taken on the lines IX—IX in FIG. 8.

As best seen in FIG. 9, the mounting part 56 may be arranged between the end wall 60 and the bearing part 57, and the bearing part 57 and the opposing end wall 60 in each case. As a result, lateral faces 63 of the bearing part 57 effect accurate lateral guidance of the front jaw 22 or of the supporting element 4. Angular adjustment as shown in FIG. 8 and relative movement of the part 56 in the longitudinal direction of the ski 1, with respect to the front jaw 22 as a result of the deformation of the ski 1 can also be provided for. If the mounting part 56 consists of an elastically deformable material, for example a metal rubber block or a plastics block, damping of the relative movements between the coupling part 5 and the ski 1 is achieved in addition to the free deformability or the possibility of angular shifting of the ski 1 relative to the coupling part 5. During deflection or deformation of the ski 1 in both directions, the damping effect can easily be adapted to differing conditions, for example during racing, to differing requirements for downhill skiing, slalom or giant slalom, by virtue of the rigidity or the elasticity of the mounting part 56.

Figure 10:
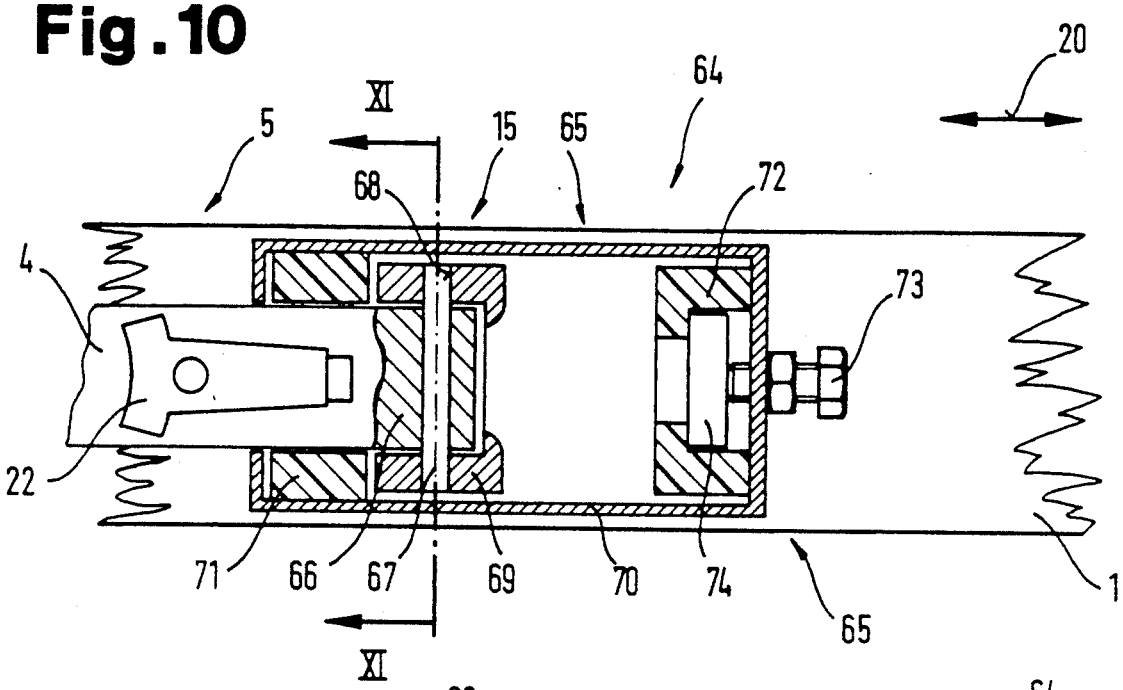
FIG. 10 is a plan view, partly in section and showing a further embodiment of the mounting device.
Figure 11:
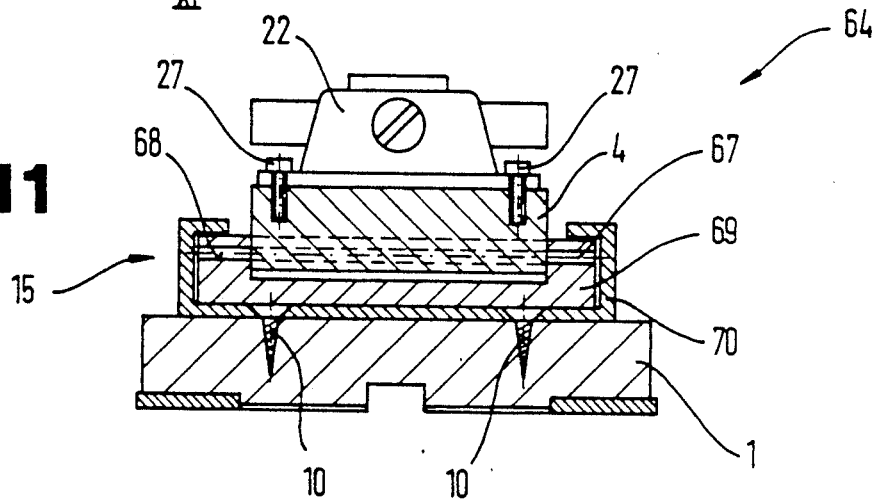
FIG. 11 is a view taken on the lines XI—XI in FIG. 10.
Figure 12:
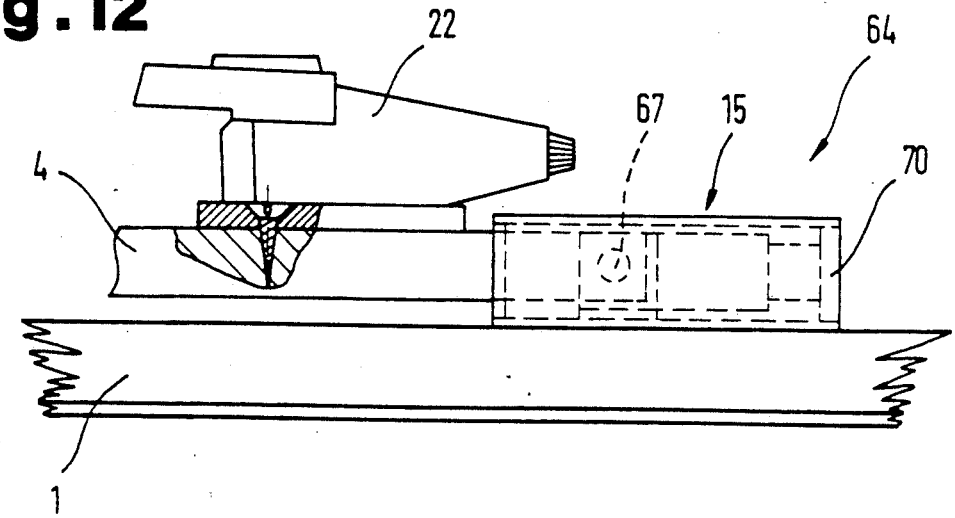
FIG. 12 is a side view, partly in section of FIGS. 10 and 11.

FIGS. 10 to 12 show a mounting device 64 which forms a common component with the longitudinal guide arrangement 15 and a damping device 65. A mounting part 66 of the mounting device 64 is formed by a supporting element 4 or a correspondingly constructed part of a coupling part 5, for example a front jaw 22. The front jaw 22 can be fixed adjustably on the supporting element 4 by way of fixing means 27, as best seen in FIG. 11. There extends through the mounting part 66, a pivot pin 67 which is rotatably mounted, with its end projecting laterally beyond the mounting part 66, in a bore 68 in a mounting part 69. The mounting part 69 simultaneously provides a guide element of the longitudinal guide arrangement 15. This guide element which is adjustable relative to the ski 1 of the mounting part 69 is guided in a guide element 70 fixed to the ski 1. The guide element 70 is, for example, a rail of C-shaped cross section which extends in the longitudinal direction (double arrow 20) off the ski 1 and is fixed to the ski 1 by fixing means 10. The mounting part 69 which acts as a further guide element is fixed so as to be longitudinally movable, in the said C-shaped guide rail. The supporting element 4 or the coupling part or the front jaw 22 or also the rear jaw 23 can, therefore, rotate about the pivot pin 67 so that the ski can assume an optional angular position relative to the coupling part 5 or the supporting element 4 again, as in the embodiments described above. At the same time, the longitudinal variations resulting from differing bending of the ski 1 owing to the difference between the size of the toe and the arc can be compensated for by a relative movement of the mounting part 69 with respect to the guide element 70 by means of the longitudinal guide arrangement 15. To damp this movement, at least in its end regions, so that sudden decelerations in movement cannot occur when the end of the adjusting movement is reaching, damping members 71 and 72 of the damping device 65 are provided, which can simultaneously act as end stops. Deformation of the ski 1 which is unaffected by the damping device 65 can be guaranteed by the choice of elasticity of the damping members 71 and 72 and by the free path between them, while more or less pronounced damping of the adjustment movement or deformation movement of the ski relative to the coupling device 7 or the coupling parts 5 and 6 can be achieved toward the end of the adjusting path. Damping of said deformation movement can be carried out in the same direction as the length compensation between ski and coupling device is to occur. Other damping devices need not, therefore, be provided.

In order to allow rapid adjustment of the damping effect or of the adjusting path of the mounting part 69, there can be provided an adjusting gear 73 with which a holder 74 on which the damping member 72 is arranged, can be adjusted in the direction of the double arrow 20. A different spring characteristic can also be achieved as the adjusting path increases or decreases, by arranging a further spring element between the adjusting gear 73 and the holder 74.

Figure 13:
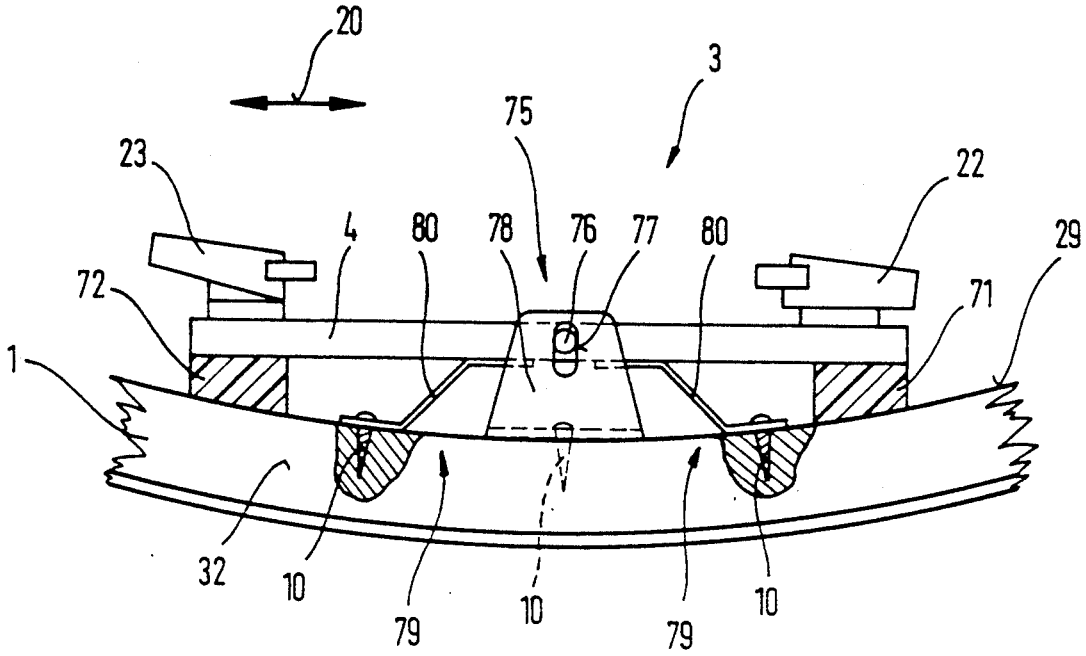
FIG. 13 is a greatly simplified diagrammatic side view partly in section, showing yet another embodiment of the mounting device.

FIG. 13 shows an embodiment of a connecting arrangement 3 in which a supporting element 4 is guided substantially without clearance both in the longitudinal direction (double arrow 20) and in the direction of the lateral edges 32 of the ski 1 by way of a mounting device 75 arranged in the central region thereof. In order to allow free movement of the ski 1 in the event of its deformation during travel, as described above, the supporting element 4, or a part connected thereto, is provided with a pivot pin 76 which is adjustable substantially perpendicularly to the upper face 29 in a guide element formed by an elongate slot 77 in a mounting part 78 which is fixed to the ski 1 by fixing means 10. In order to stabilise the supporting element 4 relative to the ski 1 in the vertical direction, the supporting element 4 is also supported on the upper face 29 of the ski 1 in the region of the two ends of the element 4 by way of damping members 71 and 72. The rigidity and elasticity of the damping members 71 and 72 are adapted so as to allow of angular adjustment between the ski 1 and the supporting element 4 and damping in a direction perpendicular to the upper face 29. If the damping effect of the damping members 71 and 72 is not sufficient or if these members are unsuitable for exerting a damping effect, by reason of the material thereof, a further damping device 79 can be arranged in the region of the mounting part 78. The device 79 may, for example, comprise leaf spring damping members 80 rigidly connected at one end to the ski and resting against the side of the supporting element 4 facing the upper face 29 of the ski and being optionally connected thereto so as to be longitudinally. The forces are, therefore, transferred uniformly by way of the damping member 71, 72 or 80 onto the ski, when the ski is loaded by a user, and the ski 1 can be deformed without obstruction relative to the supporting element 4, which is resistant to bending.

As explained above, any coupling device of optional design consisting of a front jaw 22 and a rear jaw 23 can be arranged on the supporting element 4, as indicated schematically.

Figure 14:
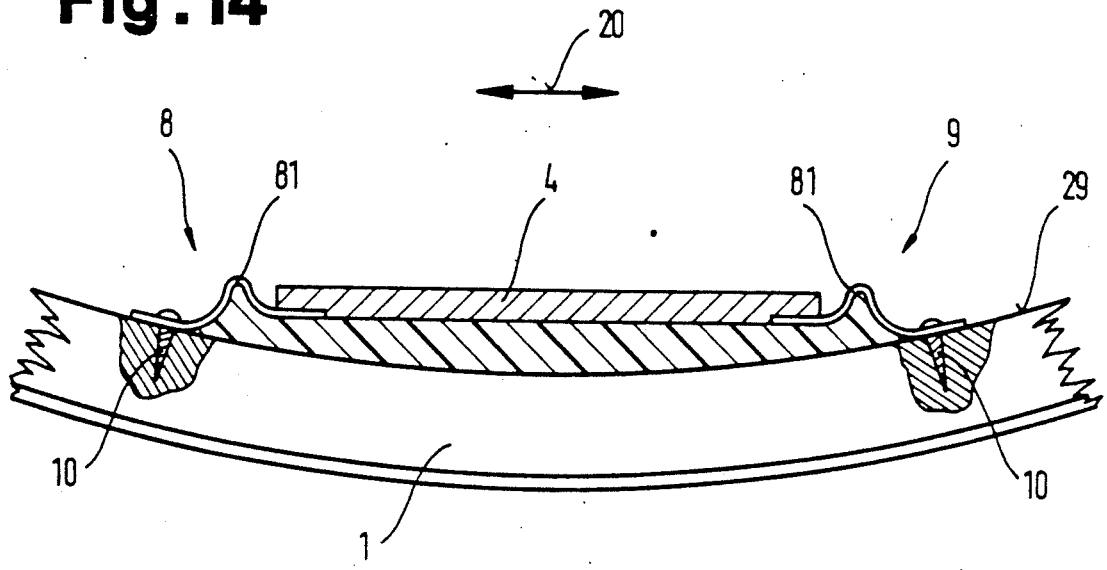
FIG. 14 is a greatly simplified, diagrammatic side view partly in section showing yet another embodiment of the mounting device.

According to the embodiment of FIG. 14 mounting devices 8 and 9 for a supporting element 4 are each constituted by an elastically deformable mounting part 81 fixed at one end to the ski 1 by means of fixing means 10 and being movably connected to the supporting element 4 at its other end. Suitably stable lateral guidance between the supporting element 4 and the ski 1 can be achieved by constructing the mounting part 81 in the form of a cranked or lyre-shaped leaf-spring. By virtue of the lyre-shaped or bent back design of the leaf springs these allow relative movement between the supporting element 4 and the ski 1 in the longitudinal direction of the ski (double arrow 20) and also perpendicularly to the upper faced 29 of the ski. The movability of such a mounting part 81 can also be increased if the leaf spring is constructed with walls of differing thicknesses so that deformation paths defined according to the stresses can be achieved.

According to the embodiment of FIG. 15 a connecting arrangement 82 comprises a mounting device 8 arranged in the region of a front jaw 22 consists of a mounting part 12 rigidly fixed to the ski 1 and the mounting part 11 formed by a pivot pin 16. In this case, the pivot pin 16 is mounted directly in the supporting element 4 and is formed integrally therewith. On the supporting element 4, next to the front jaw 22, there is also arranged a rear jaw 23 in the region of which the supporting element 4 is supported on the upper face 29 of the ski 1 by way of a mounting member 83 of a resilient material. A damping device 65 having a pivotable lever 84 with a roller 85 resting on the upper face of the ski 1 is also arranged in the supporting element 4. The lever 84 is pivotal about a pivot pin 86 against the action of a damping member 87 in the form of a helical spring, in the direction of the upper side of the supporting element 4 facing the front jaw 22 and rear jaw 23. The spring characteristic of the damping member 87 we well as the maximum stroke in the direction of the upper face 29, of the roller 85, can be adjusted by means of a screw gear 88. A correspondingly adjustable stop 89 extending in the opposite direction can also be provided. The end position of the roller 85 can be adjusted relative to the supporting element 4 according to height, by adjusting the stop 89 which is equipped with a steeply inclined plane surface, and a defined minimum distance between the upper face 29 and the surface of the supporting element 4 remote therefrom can also be adjusted. The spring characteristic can be adapted to the differing requirements in each case by selecting different damping members 87, for example corresponding resilient rubber elements or the like.

In the embodiment of FIG. 16, a supporting element 4, as in FIG. 15, is connected to the ski by way of a mounting device 8 comprising a mounting part 12 rigidly fixed to the ski and a mounting part connected to the supporting element 4, for example the pivot pin 16. A front jaw 22 and a rear jaw 23 are arranged on the supporting element 4. The end of the supporting element 4 in the region of the rear jaw 23 is supported on the upper face 29 of the ski 1 by a mounting device 9, the angular adjustability and the relative adjustment in the longitudinal direction (double arrow 20) being achieved in that the mounting device comprises a mounting part 90 rigidly fixed to the upper face 29 of the ski and a mounting part 91 which is movably connected to the supporting element 4 and, in the present case, is made of a deformable material, being for example a deformable leaf spring or a corresponding attenuation in the material of the supporting element 4. The effects of the relative movement of the ski with respect to the supporting element 4 or the coupling device 7 described above with reference to FIGS. 1 to 7 are therefore achieved with the provision of few individual parts.

In the embodiment of FIG. 17 a supporting element 4 is supported on the upper face 29 of the ski 1 by a continuous mounting member 92. The supporting element 4 is fixed both in the longitudinal direction (double arrow 20) of the ski 1, and in the direction of the lateral edges 32 by way of the resilient plastics material of which the mounting member 92 is made and is movably connected both to the supporting element 4 and the ski 1 in a positive and/or non-positive manner, for example, by adhesion or fusing a UV bond. A front jaw 22 and a rear jaw 23 are again arranged on the supporting element 4, as described above.

As shown in FIGS. 17 and 18, in order to prevent lateral deviation of the supporting element 4 relative to the ski 1, under extreme lateral forces, that is to say during insertion of the edge of the ski when travelling fast round bends, the supporting element 4 is provided, at least over a part thereof, for example in the region of the front jaw 22 and the rear jaw 23, with a stop strip 93 which extends in the direction of the upper face 29 of the ski and rests against a bearing strip 94 located between the lateral edge 32 of the ski and the stop strip 93, the bearing strip 94 being arranged on a side remote from an upper side 95 of the supporting element 4. The supporting element 4 is guided with clearance between the two bearing strips 94 which, together with the stop strips 93, form a lateral guide device 96, for example, into the position indicated in broken lines, even during shifting of the ski 1 as a result of deformation thereof. In order to prevent icing up or blockage between the moving parts, due to drifting snow, the region between the lateral edge 32 and the upper side 95 of the supporting element 4 is covered by a covering element 97 which is resilient at least perpendicularly to the upper face 29 of the ski 1. As indicated schematically, this covering element 97 is fixed in the lateral edge 32 by fixing means 98, for example screws or rivets, or is also connected integrally to the surface layer owing to a suitable design. For example, the covering element 97 can also be adhered or UV-bonded on the ski 1. The covering element 97 then extends from there into the region of the upper side 95 of the supporting element 4 and is also connected to the supporting element 4 in this region by non-positive and/or positive fixing, for example adhesion, bonding or clamping. Exact, clearance-free transfer of the lateral forces to be applied to the ski 1 can now take place independently of the continuously changing distances and relative positions between the ski 1 and the supporting element 4.

Differing relative positions between the supporting element 4 and the ski 1 during travel are shown in FIGS. 19 and 20. In this embodiment, the supporting element 4 is connected to the ski 1 via a mounting member 92. To prevent snow from penetrating between supporting element 4 and the ski 1 during relative movements thereof, a covering element 97 in the form of a concertina wall is provided. If the ski 1 is markedly deflected and the distance 99 is increased to correspond to the rest position between these two parts to a distance 100 as shown in FIG. 19, then the concertina wall or the concertina-like covering element 97 is extended from the folded position shown in FIG. 20. As shown in FIG. 19, the concertina wall is then stretched and the continuously changing intermediate space between the ski 1 and the supporting element 4 is therefore reliably covered. This design of the covering element 97 and the arrangement thereof is also particularly advantageous if the supporting element 4 is fixed to the ski 1 by means of mounting devices 8 and 9 as described above, the mounting devices 8 and 9 not extending over the entire area of contact between the ski 1 and the supporting element 4. The risk of penetration of snow and ice is considerably greater in these cases than in the embodiments in which the supporting member 92 extends over the entire contact area between the ski 1 and the supporting element 4.

Instead of the concertina wall, there may be provided, any other construction of strips which can be pushed into one another and plastic or metal elements which can be deformed by extension in order to provide a secure cover which is resistant to impacts and cuts even at the most varied temperatures, in particular very low temperatures, for the cavity which may be formed between the supporting element 4 and the ski 1.

The covering element 97 may, however, consist of an elastically deformable material such as plastics foam or rubber and, as indicated by the broken line hatching in FIG. 7, may be used to fill the intermediate space between supporting element 4 and ski 1 without producing particular damping and spring effects and only to prevent the penetration of snow into the intermediate space.

Figure 21:
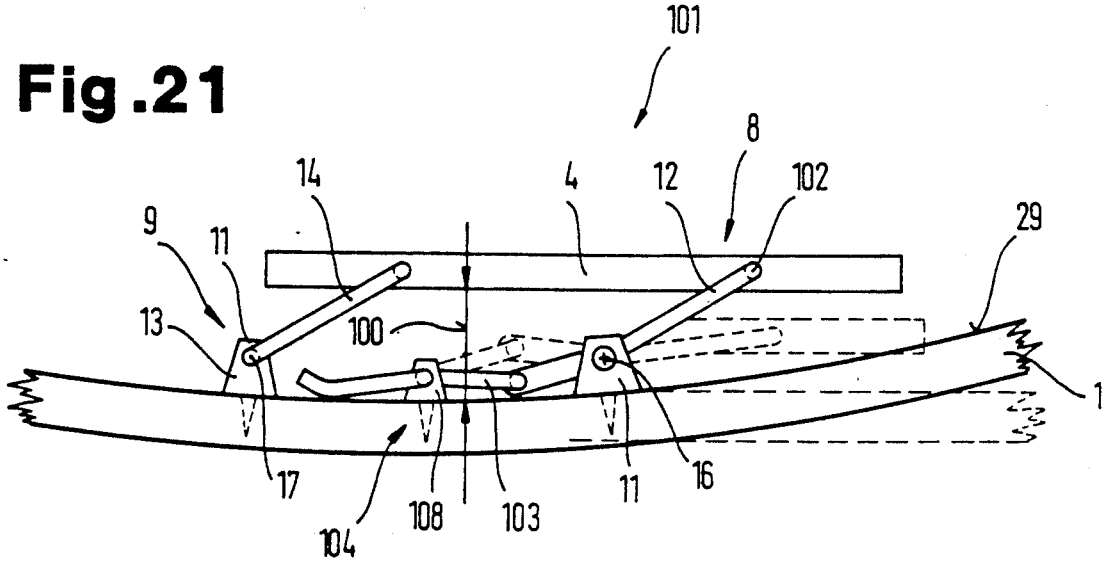
FIG. 21 is a simplified diagrammatic side view showing yet a further embodiment of a mounting device for the connecting arrangement.
Figure 22:
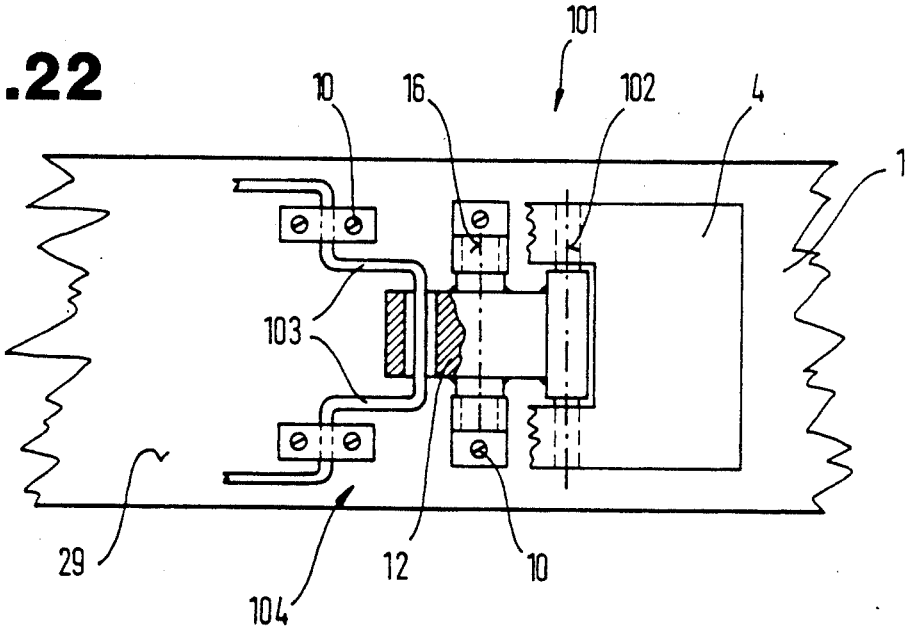
FIG. 22 is a plan view of FIG. 21 shown partly in section.

FIGS. 21 and 22 show a further embodiment of the connecting arrangement which is referenced 101, in highly simplified schematic form. The connecting arrangement 101 comprises two mounting devices 8 and 9 which each consist of a mounting part 11 rigidly fixed to the ski and a mounting part 12 which is formed, for example, as a toggle lever and is pivotally mounted about a pivot pin 16 in the mounting part 11. One side of the mounting part 12 is pivotally mounted on the supporting element 4 by means of a pin 102 while the opposite end of the mounting part 11 is supported by a damping member 103, for example a torsion spring of a damping device 104. The two mounting parts 11 are fixed to the upper face 29 of the ski 1 by fixing means 10. An indentation in which the damping member 103 is fixed, is provided in the side of the mounting part 122 remote from the supporting element 4. The damping member 103 is also fixed at the side remote from the mounting part 12 on the upper face 29 of the ski 1 by fixing means 10, for example via cover plates.

As will be apparent from FIG. 21, the damping member 103 dampens movements of the supporting element 4 in the direction of the upper face 29 of the ski 1. In fact, if the supporting element 4, which is shown in its position with the ski 1 highly deformed, is suddenly moved in the direction of the ski, for example when the binding region reaches a peak of a hump, then impact on the user can be avoided in that the deformation of the damping member 103 counteracts the reduction in the spacing or the distance 100, between the supporting element 4 and the ski 1. As a result of adjustment of the arm of the mounting part 12 facing the damping member 103, into the broken line position of FIG. 21. The relative movement between supporting element 4 and ski 1 is correspondingly decelerated and damped to reduce the distance 100. On the other hand, slight initial tension of the ski in the direction of the running face 30 is achieved by the prestressed damping member 103 during travel, so that adaptation which is as accurate as possible or harmonious deformation as a function of the terrain conditions and therefore an edge grip which is as continuous as possible over the entire length of the ski 1, are achieved.

The mounting part 14 may be formed according to the mounting part 12 which the mounting device 8 in the region of the mounting device 9. The two mounting parts 12 and 14 may be constructed as angle levers acting as a parallel linkage arrangement, each of these angle levers having its own damping member 103. The mounting parts 12 and 14 may instead be constructed as simple levers to provide their own damping members.

Instead of the damping member 103 being in the form of a torsion spring, corresponding bending springs such as leaf spring elements or helical springs may be used. The damping and spring characteristic of the damping members may be adjustable by means of adjusting devices allocated thereto.

Figure 23:
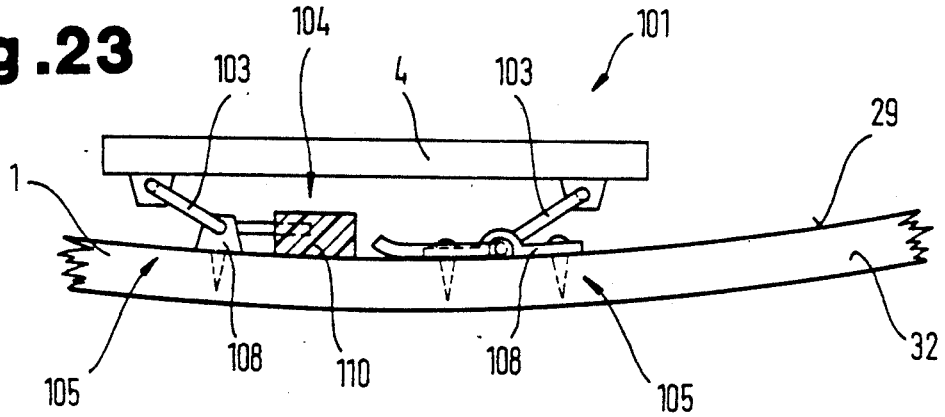
FIG. 23 is a side view partly in section showing yet another embodiment of the connecting arrangement.

FIG. 23 shows another embodiment of a connecting arrangement 101 between a supporting element 4 and a ski 1, and which comprises two mounting devices 105 constituted by damping members 103.

Figure 24:
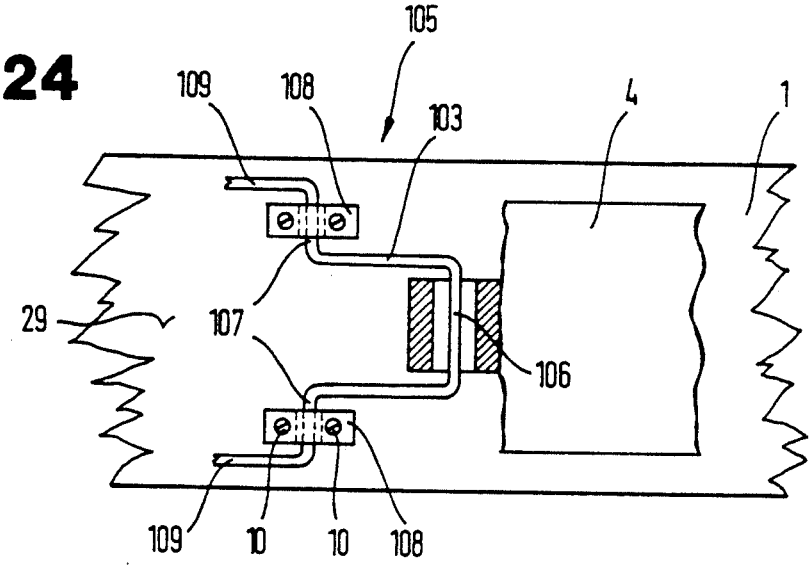
FIG. 24 is a simplified diagrammatic plan view of FIG. 23, partly in section.

As best seen in FIG. 24, each damping member 103 is constructed as a spiral spring and is suspended rotatably in the supporting element 4 by a cross head 106. Spring arms 107 are fixed in cover plates 108 on the upper face 29 of the ski 1. If the supporting element 4 moves away from the ski 1, the spring arms 107 are subjected to torsion, and twist whilst being supported on supporting arms 109 so that a retaining force counteracts the deflecting movement of the supporting element 4 relative to the ski 1. Conversely, in order to avoid impacts when the spacing between the supporting element 4 and the ski 1 is reduced, a damping member 110 of the damping device 104, for example, a damping block of resilient plastics material or rubber material, can be provided between the ski 1 and the supporting element 4. The deflecting movements are thus damped during the deflection of the ski and also during its return into a normal position.

Figure 25:
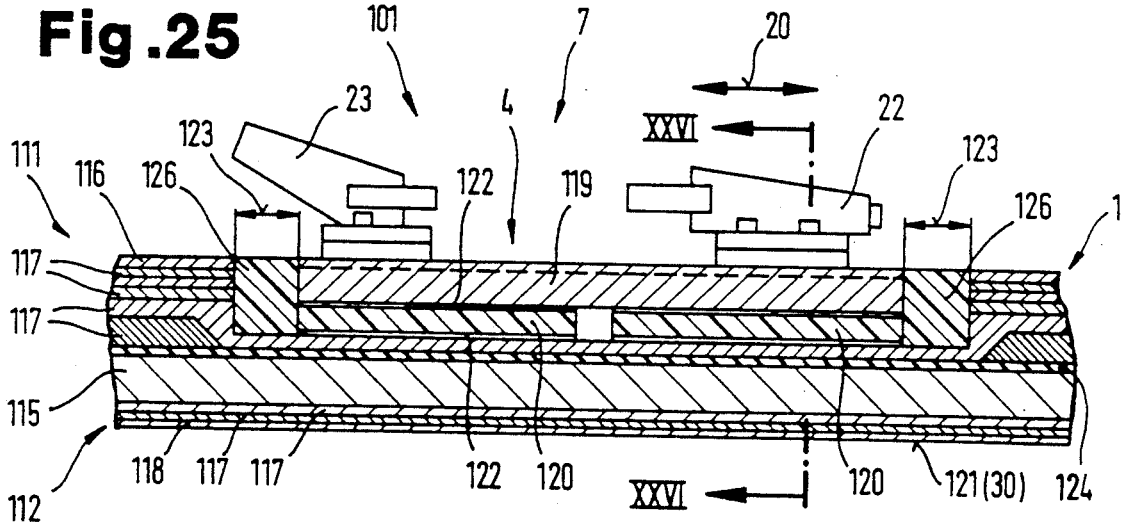
FIG. 25 is a simplified diagrammatic side view partly in section, of yet a further embodiment of the connecting arrangement.
Figure 26:
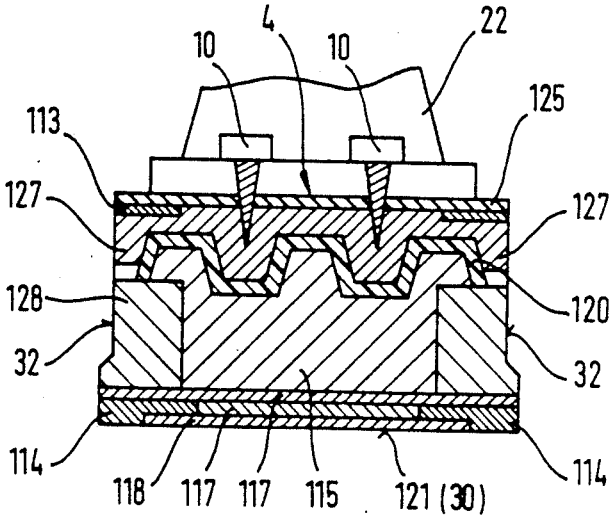
FIG. 26 is a view taken on the lines XXVI—XXVI in FIG. 25.

A further embodiment of a connecting arrangement 101 for mounting a coupling device 7 consisting of a front jaw 22 and a rear jaw 23 for a ski boot is shown in FIGS. 25 and 26.

A ski usually consists of an upper and lower supporting layer 111 and 112, upper edges 113, running edges 114 and a core 115. Each of these upper and lower supporting layers 111 and 112 may consist of several layers, for example an upper face layer 116, various bearing layers 117 in the case of the upper supporting layer 111, as well as a covering 118 and several bearing layers 117 in the case of the lower supporting layer 112. The core 115, which may be made of aluminium, wood, plastics material, for example, may be constituted by several layers.

The supporting element 4 for the coupling device 7 comprises a supporting layer part 119 in the present case, which is placed on the supporting layer 111. The layer part 119 may either have the same layered structure as the supporting layer 111, or it may be constructed with additional reinforcing inlays and elements, or it may consist of a different material, for example of an aluminium pressed profile or an aluminium plate. The layer part 119 is fixed to the ski 1 by a mounting member 120 composed of a plastics material or rubber, which is elastically deformable perpendicularly to the running face 121. As indicated schematically, the mounting member 120 is connected by way of an adhesive layer 122 both to the upper supporting layer 111 and to the supporting layer part 119. The connection may also be produced by a sheet moulding compound, that is to say an inlay previously doped with foaming agent or resins, which reacts fully under the influence of pressure or temperature.

By virtue of the arrangement of an intermediate space 123 extending in the longitudinal direction (double arrow 20) between the supporting element 4 and the adjacent parts of the surface layer 116 or of the supporting layer 111, this remaining surface layer 116 or supporting layer 111 can shift together with the core 115 and the lower supporting layer 112, both in its relative spacing from the supporting element 4 and in its position in said longitudinal direction. Because of this possibility of longitudinal movement by virtue of the intermediate spaces 123, the difference in length of the core 115 or of the lower supporting layer 112 which corresponds to the difference in size between the arc and the toe due to deformation of the ski can be compensated for. The arrangement of its own supporting element 4 can therefore become unnecessary and the advantages of free deformability and harmonious stress diffusion of the ski relative to the supporting element 4 which is resistant to bending or deformation and which fixes the ski boot, can still be achieved.

By suitable shaping of the supporting element 4 or of the supporting layer part 119, as shown in particular in FIG. 26, the supporting element 4 or the supporting layer part 119 may be provided with corresponding reinforcing elements, for example, continuous reinforcing strips, or with screw bushes in order to connect the front jaw 22 and the rear jaw 23 to the supporting element 4 by fixing means 10. With such an arrangement the strength values of the ski construction can be maintained, in particular the screw stripping values for fixing the coupling device 7 in the range required for the various applications of the ski, namely between about 2,500 and 4,000 N even if the supporting element 4 integrated into the ski.

The upper supporting layer 111 may be connected only at points, by means of individual spring elements instead of connecting the whole area of the supporting element 4 to the supporting layer 111 or to a bearing layer 124 of the upper supporting layer 111. There must, however, be sufficient free space between the ski 1 and the supporting element 4, even in the region where there is no mounting member 120, so that the relative movement of supporting element 4 and ski 1 is unobstructed.

Transition parts 126 for closing intermediate spaces 123 may be inserted into the intermediate spaces 123 so that ice and snow cannot penetrate thereinto. To this end, said parts 126 may consist of a resilient jointing composition or, for example, a foam plastics or rubber. The elasticity of the transition part 126 may be such that it can be used as damping member.

As best seen in FIG. 26, the supporting element 4 or the supporting layer part 119, may be provided in the region of the lateral edges 32 of the ski, with projections 127 directed towards the running face 30. The projections 127 may be so dimensioned that, in a rest position of the ski, the supporting layer part 119 and the adjacent surface layers 116 of the upper supporting layer 111 are aligned, that is to say they are equidistant from the running face 30. These projections 127 in connection with lateral cheeks 128 provide an end stop defining the minimum spacing between the running face 30 and the supporting element 4.

The mounting member 120 may extend into the region of the lateral edge 32, that is to say it may be provided between the supporting element 4 and a lateral cheek 128.

Figure 27:
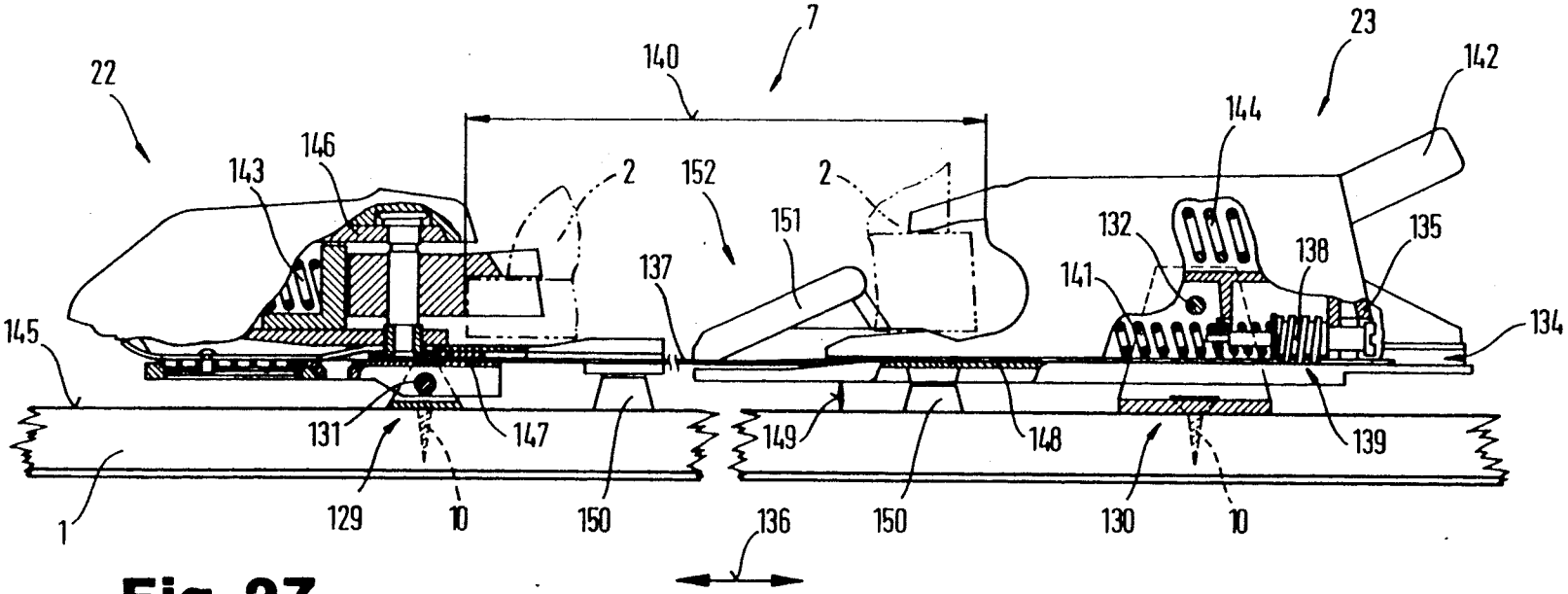
FIG. 27 is a sectional side view of a connecting arrangement according to yet a further embodiment of the invention.
Figure 28:
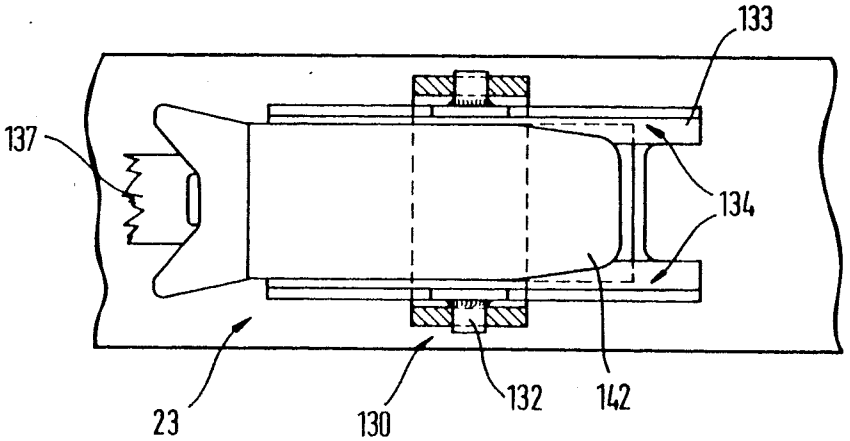
FIG. 28 is a fragmentary plan view in transverse section, of the connecting arrangement of FIG. 27.

Another embodiment of the connecting arrangement comprising a coupling device 7 for fixing the ski boot 2 on the ski 1 and comprising a front jaw 22 and a rear jaw 23 is shown in FIGS. 27 and 28.

Bearing blocks 129 and 130, respectively, are secured on the ski 1 in the area of the front and rear jaws 22 and 23, by means of fixing means 10, for example wood or plastics material screws. The bearing block 130 receives either a transpiercing pivot pin 131 or two bearing pivots 132 which are fastened at either side to a locating plate 133. For example, by welding. The front jaw 22 and the rear jaw 23 are pivotable about the pivot pin 131, or the bearing pins 132, with respect to the ski 1. The locating plate 133 has a guiding slot 134 in which a casing 135 of the rear jaw 23 is displaceably mounted in the longitudinal direction of the ski as indicated by the arrow 136. The rear jaw 23 and the ski 1 may thereby be displaced or shifted with respect to one another.

In order to allow of engaging the ski boot 2 between the front jaw 22 and the rear jaw 23, the front jaw 22 which is pivotal about the pivot pin 131, but is fixedly arranged in the longitudinal direction of the ski, is coupled to the rear jaw 23 via a tensioning strap 137. To this end, a worm gear 138 meshes with recesses 139 in the tensioning strap 137. A space 140 between the front and rear jaws 22 and 23 may thereby be adapted to different boot sizes and initial tension of the rear jaw 23 with respect to the front jaw 22 may supplementally be set by means of a compression spring 141. The compression spring 141 ensures that the ski boot 2 is securely held between the front and rear jaws 22 and 23 during use of the ski 1. Release of the ski boot 2 from the coupling device 7 or rather from the front and rear jaws 22 and 23 can be effected only by unlocking the rear jaw 23 by means of a setting lever 142, or where release values set to cope with a fall, by means of spring elements 143 and 144, are exceeded. The precise function of these spring elements 143 and 144 and their associated parts are known, and will not therefore be described here.

By means of the tensioning strap 137, the rear jaw 23 is always held at a precise predetermined distance from the front jaw 22 and in case of deformations of the ski 1, the same may be displaced freely in the area of the rear jaw 23 in the longitudinal direction of the ski 1, arrow 136, with respect to the rear jaw 23 by relative displacement of the locating plate 133 with respect to the rear jaw 23.

To this end, the tensioning strap 137 should have no more than adequate tensile strength so that the pretensioning force as well as the tensional forces arising during use of the ski can be reliably transmitted between the front and rear jaws 22 and 23. To this end, the tensioning strap 137 may also be made pliable or elastic in a direction at right angles to the ski surface 145. To allow of trouble free insertion of the ski boot 2 into the front and rear jaws 22, 23 a tread plate or the like 147 and 148 respectively, is in each case rigidly jointed to the casing 135 of the rear jaw 23 and to a casing 146 of the front jaw 22, respectively. If, to this end, the front and rear jaws 22 and 23, shown as being somewhat enlarged in the interest of clarity, are situated at a greater distance 149 from the ski surface 145, spacers 150 may be provided. The front and rear jaws 22 and 23 may then be held at a position approximately parallel to the ski surface 145 by means of the spacers 150. These spacers 150 may be made of elastically damping material, being for example rubber buffers, to provide a damping action may during ski warping in the direction of the tensioning strap 137. A perfect interlock between the front and rear jaws 23 can thereby be ensured under different conditions, in particular upon getting the boot into the front and rear jaws 22 and 23 off-track after a fall, for example in powder snow.

FIG. 27 also shows an actuator plate 151 for a ski brake 152 which may be fastened or hinged on the tread or analogous plate 148. If the spacing between the tread surface of the ski boot 2 and the ski surface 145 is smaller and if the tensioning strap 137 is of adequate strength, the tread polates 147, 148 may be omitted, although the incorporation of spacers 150 is nevertheless advisable in the case of greater spacing between the tensioning strap 137 and the ski surface 145.

The space 149 is primarily required if the pivot point of the front and rear jaws 22 and 23 is not, in each case, situated in the terminal areas of the two jaws facing away from one another, but comparatively close to the ski boot 2 as in the present embodiment. In order to authorise adequate relative displacement between the ski 1 and the front and rear jaws 22, 23, a smaller or greater space 149 should be retained, depending on the structure of the front and rear jaws 22, 23. The front and/or rear jaws 22, 23 may be rounded off forwardly to an extent corresponding to the maximum radius of curvature of the ski about the pivot pin 131 or may be vertically offset. Such an arrangement of the pivot pins 131 could also be used where front and/or rear jaws 22, 23 rest directly on the ski surface 145.

The form and arrangement of the pivot pins 131 or of the bearing pins 132 may however, be modified at will to comprise a single pivot spindle or more than one pivot pin. Damping means for damping the shifting or deforming movements of the ski 1 with respect to the coupling device 7 may be associated with the separate front and rear jaws 22 and 23 or with the rear jaws 23 displaceable with respect to the locating plate 133. The longitudinal displaceability of the coupling device 7 with respect to the ski may be allowed to operate by virtue of the possibility of relative displacement of the front jaw 22 with respect to the ski 1, the rear jaw 23 being fixed with respect to the longitudinal direction of the ski (arrow 136).

If the bearing blocks 129 and 130, respectively, are made in split form with respect to a plane extending parallel to the ski in the area of the pivot pins 131 or of the bearing pins 132 or rather if the pivot pins 131 or the bearing pins 132 are arranged to be easily releasable and withdrawable transversely to the longitudinal direction of the ski (arrow 136), it is possible with a minimum of operating steps to free the whole coupling device 7 comprising front and rear jaws 22, 23 from the ski 1. This would also establish a possibility of allowing the coupling device adjusted to the user's ski boots 2 and thus complying with technical safety requirements, to be transferred rapidly from one ski to another.

Figure 29:
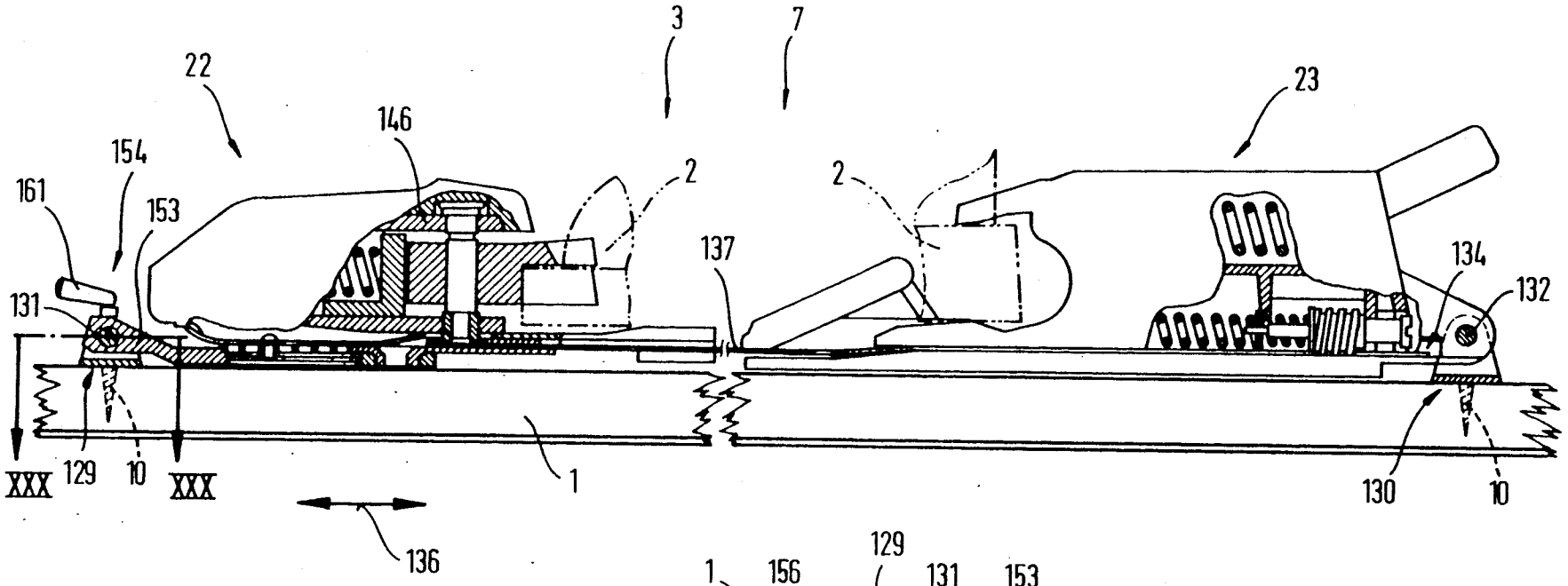
FIG. 29 is a sectional side view illustrating modifications of the connecting arrangement of FIGS. 27 and 28.
Figure 30:
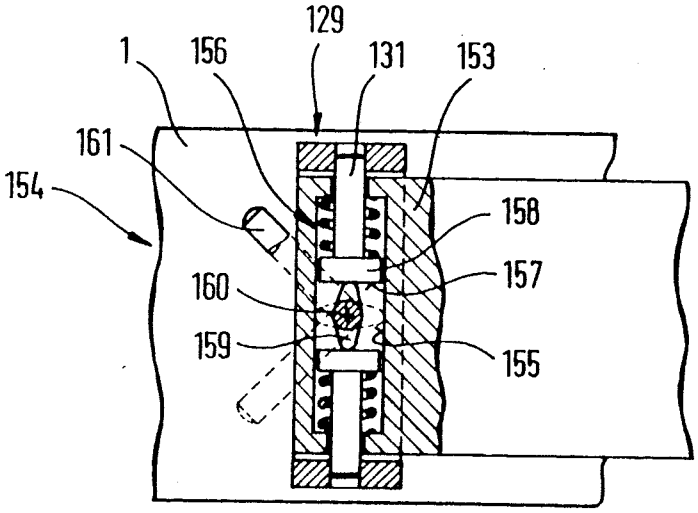
FIG. 30 is a view taken on the lines XXX—XXX in FIG. 29.

FIGS. 29 and 30 show a modification of the coupling device 7, of FIGS. 27 and 28. Like parts in FIGS. 27 and 28 and FIGS. 29 and 30 bear the same reference numerals.

This coupling device 7 differs from that of FIGS. 27 and 28 in that the bearing blocks 129 and 130 are installed in the areas of the oppositely facing ends of the front and rear jaws 22, 23. The front jaw 22 is installed on a base plate 153 with respect to which the casing 146 of the front jaw 22 is displaceable in the longitudinal direction of the ski 1 (arrow 136) the displacement of the front jaw 22 with respect to the base plate 153 may to this end be performed in accordance with the teaching of EP-A-84 324 which is hereby incorporated herein by reference.

The base plate 153 and the bearing block 129 may be coupled via a locking device 154. Bearing pins 132 arranged opposite to one another and displaceable along their longitudinal axes are provided in a recess 155 in the base plate. Spring systems 156, for example coil compression springs, thrust the bearing pins 132 with their end faces 157 of their flange shaped extremities against an eccentric 159 arranged between the end faces 157. This may be pivotally displaced by means of a lever 161 about a pivot pin 160 which is lined up at right angles to the longitudinal axis of the bearing pins 132. In the position shown in full lines, of the lever 161 and of the eccentric 159, the separate bearing pins 132 are pressed into the reception bores of the securing block 29 against the action of the spring system and the base plate 153 is thus locked to the securing block 129. If the eccentric 159 is pivotally displaced by means of the lever 161 into the position shown in broken lines, the bearing pins 132 are drawn back by spring action and emerge from the bearing block 129. This frees the base plate 153. It is possible thereby to draw the rear jaw 23 by means of the tensioning strap 137 joined to the same, out of the guiding slot 134 and thus to free the coupling device 7 from the ski 1 with but few operating steps, for example to use the same on another ski 1. The mode of operation of the locking device 154 may be reversed so that a spring force induces the locking action and the release of the locking device is performed via a lever and/or eccentric system. The bearing block 129 may, however, be joined to the ski 1 or a mounting plate by means of a bayonet joint.

What is claimed is

1. A connecting arrangement for fixing a ski boot to a ski extending in a longitudinal direction between opposite ends of the ski, comprising a supporting element having opposite ends; a coupling device arranged on the supporting element, the coupling device having coupling parts for the ski boot; and two mounting devices for fixing the supporting element to the ski at a predeterminable distance from the ski ends and extending in a plane extending transversely to the longitudinal direction of the ski, at least one of said mounting devices including structure arranged between the ends of the supporting element and of the ski said at least one mounting device including two mounting parts, one of the mounting parts being fixed to the ski and the other mounting part being pivotal on the fixed mounting part about a horizontal pivot pin extending perpendicularly to the longitudinal direction, said one of the mounting devices further including a longitudinal guide device, the longitudinal guide device comprising two guide elements longitudinally displaceable relative to each other, one of the guide elements being connected to the pivotal mounting part of the one mounting device for pivoting therewith while the other guide element is coupled to the suporting element.

2. The connecting arrangement of claim 1, further comprising a vibration damping device arranged between the supporting element and an upper face of the ski, the damping device being constructed to damp vibrations in a direction extending substantially perpendicularly to the upper ski face.

* * * * *